US009695597B2

(12) United States Patent
Wagner

(10) Patent No.: US 9,695,597 B2
(45) Date of Patent: Jul. 4, 2017

(54) INSTALLATION SYSTEM FOR WOODEN BOARDS

(71) Applicant: Pacific Western Timbers, Inc., Bremerton, WA (US)

(72) Inventor: John W. Wagner, Seabeck, WA (US)

( * ) Notice: Subject to any disclaimer, the term of this patent is extended or adjusted under 35 U.S.C. 154(b) by 0 days.

(21) Appl. No.: 14/791,003

(22) Filed: Jul. 2, 2015

(65) Prior Publication Data

US 2017/0002572 A1 Jan. 5, 2017

(51) Int. Cl.
*E04F 13/08* (2006.01)
*E04B 1/41* (2006.01)

(52) U.S. Cl.
CPC ..... *E04F 13/0819* (2013.01); *E04B 1/40* (2013.01)

(58) Field of Classification Search
CPC ..... E04F 13/0821; E04F 13/0819; E04F 13/0805; E04F 15/22; E04F 15/02; E04B 1/40; E04B 5/40
USPC ..... 52/480, 489.1, 489.2, 506.05
See application file for complete search history.

(56) References Cited

U.S. PATENT DOCUMENTS 2,005,030 A * 6/1935 Geisinger ..... E04F 13/0803 52/384
2,088,625 A * 8/1937 Wailace ..... E04F 13/0862 52/774
3,005,293 A * 10/1961 Hunter ..... E04F 13/0805 52/385
3,271,916 A * 9/1966 Omholt ..... E04F 15/22 52/393
3,387,422 A * 6/1968 Wanzer ..... E04B 5/40 52/387
4,135,339 A 1/1979 Pawlitschek
4,170,859 A * 10/1979 Counihan ..... E04F 15/02 52/391
4,395,858 A * 8/1983 Gwyther ..... E04F 13/0816 52/506.09
4,449,346 A 5/1984 Tremblay
4,461,131 A 7/1984 Pressell
(Continued)

OTHER PUBLICATIONS newtechwood.com, "Deck-A-Floor," [retrieved on Aug. 19, 2014] Retrieved from the Internet: <URL: http://www.newtechwood.com/deck-a-floor.html>, 4 pages.

(Continued)

*Primary Examiner* — Babajide Demuren
(74) *Attorney, Agent, or Firm* — Davis Wright Tremaine LLP; Heather M. Colburn; Michael J. Donohue

(57) ABSTRACT

A board assembly for mounting to one or more support structures of a ceiling, deck, floor, or wall. The board assembly includes a board and a mounting member. The board has a length along a longitudinal direction, and first and second side channels that extend lengthwise along the board. The mounting member has first and second flanges biased inwardly toward one another. The first and second flanges are configured to be received inside the first and second side channels, respectively, of the board and to press inwardly on the board to limit movement and warping by the board. A plurality of the board assemblies may be included in a kit. Such a kit may also include a plurality of clip members configured to removably couple the board assemblies to the support structure(s). The mounting member may be constructed from aluminum or an aluminum alloy.

12 Claims, 18 Drawing Sheets

(56) References Cited

U.S. PATENT DOCUMENTS 4,635,424 A * 1/1987 Drapeau ..... E04B 9/24 52/480
4,987,712 A * 1/1991 Mancuso ..... E04F 13/0862 52/387
5,022,200 A 6/1991 Wilson et al.
5,179,812 A 1/1993 Hill
5,295,341 A 3/1994 Kajiwara
5,369,927 A * 12/1994 Counihan ..... E04F 15/22 52/403.1
5,394,667 A * 3/1995 Nystrom ..... E01D 19/125 52/263
5,706,621 A 1/1998 Pervan
5,735,097 A * 4/1998 Cheyne ..... B63B 5/06 114/263
5,768,850 A * 6/1998 Chen ..... E04F 15/02044 403/386
5,797,237 A 8/1998 Finkell, Jr.
5,906,082 A * 5/1999 Counihan ..... E04F 15/02 52/403.1
6,023,907 A * 2/2000 Pervan ..... E04F 13/0801 52/403.1
6,101,775 A 8/2000 Larimore
6,134,854 A 10/2000 Stanchfield
6,182,410 B1 2/2001 Pervan
6,449,918 B1 9/2002 Nelson
6,470,641 B1 * 10/2002 Faure ..... E04B 5/12 52/391
6,550,206 B2 * 4/2003 Lee ..... E04F 15/04 52/403.1
6,564,522 B1 * 5/2003 Chiu-Ying ..... E04F 15/225 52/403.1
6,883,287 B2 * 4/2005 Niese ..... E04F 15/225 52/403.1
7,010,894 B1 * 3/2006 Cappelle ..... E04B 9/26 52/384
7,171,790 B2 * 2/2007 Mei ..... E04F 15/04 52/578
7,434,358 B2 * 10/2008 Smith ..... E04B 1/34342 52/11
7,661,228 B1 2/2010 Nolte et al.
8,276,343 B2 * 10/2012 Yang ..... E04F 15/02 52/509
8,857,121 B2 * 10/2014 Baxter ..... E04B 9/363 52/506.08
2004/0045244 A1 * 3/2004 Hafner ..... E04B 5/12 52/489.1
2005/0055973 A1 3/2005 Hagen, Jr. et al.
2005/0252143 A1 11/2005 Tataei
2006/0156664 A1 * 7/2006 Chae ..... E04F 13/0814 52/480
2006/0185297 A1 * 8/2006 Mei ..... E04F 15/022 52/506.05
2007/0119105 A1 5/2007 MacDonald et al.
2010/0132275 A1 6/2010 Stanger
2012/0216471 A1 8/2012 Manser et al.
2014/0260043 A1 * 9/2014 Cottier ..... E04F 13/0826 52/489.2
2015/0059271 A1 * 3/2015 Tsai ..... E04F 15/02194 52/302.1

OTHER PUBLICATIONS spacesaver.com, "Wheelhouse: A One-of-a-Kind Modular Mobile Shelf Solution That Allows for Easy Reconfiguration and Relocation," [retrieved on Aug. 19, 2014] Retrieved from the Internet: <URL: http://www.spacesaver.com/products/high-density-mobile-storage-shelving/wheelhouse-modular-mobile-shelving/>, 4 pages.

* cited by examiner

INSTALLATION SYSTEM FOR WOODEN BOARDS

BACKGROUND OF THE INVENTION

Field of the Invention

The present invention is directed generally to systems for constructing and installing decking, flooring, walls, wall coverings.

Description of the Related Art

Many commercial and residential structures include ceilings, decks, walls, and floors constructed using exposed boards, such as solid wooden and/or composite boards. While these ceilings, decks, walls, and floors may be attractive, they have several drawbacks. For example, the exposed boards can warp, mold, wear out, and/or rot. Unfortunately, it can be difficult and/or expensive to remove, refinish, and/or replace only some of the boards. Further, generally speaking, such boards typically cannot be reused. The life expectancy of the boards can also depend upon their proper installation (e.g., proper spacing of the boards, use of a proper underlayment, etc.). Therefore, a need exists for methods and systems for constructing ceilings, decks, walls, and floors that include exposed boards and overcome these shortcomings. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 1:
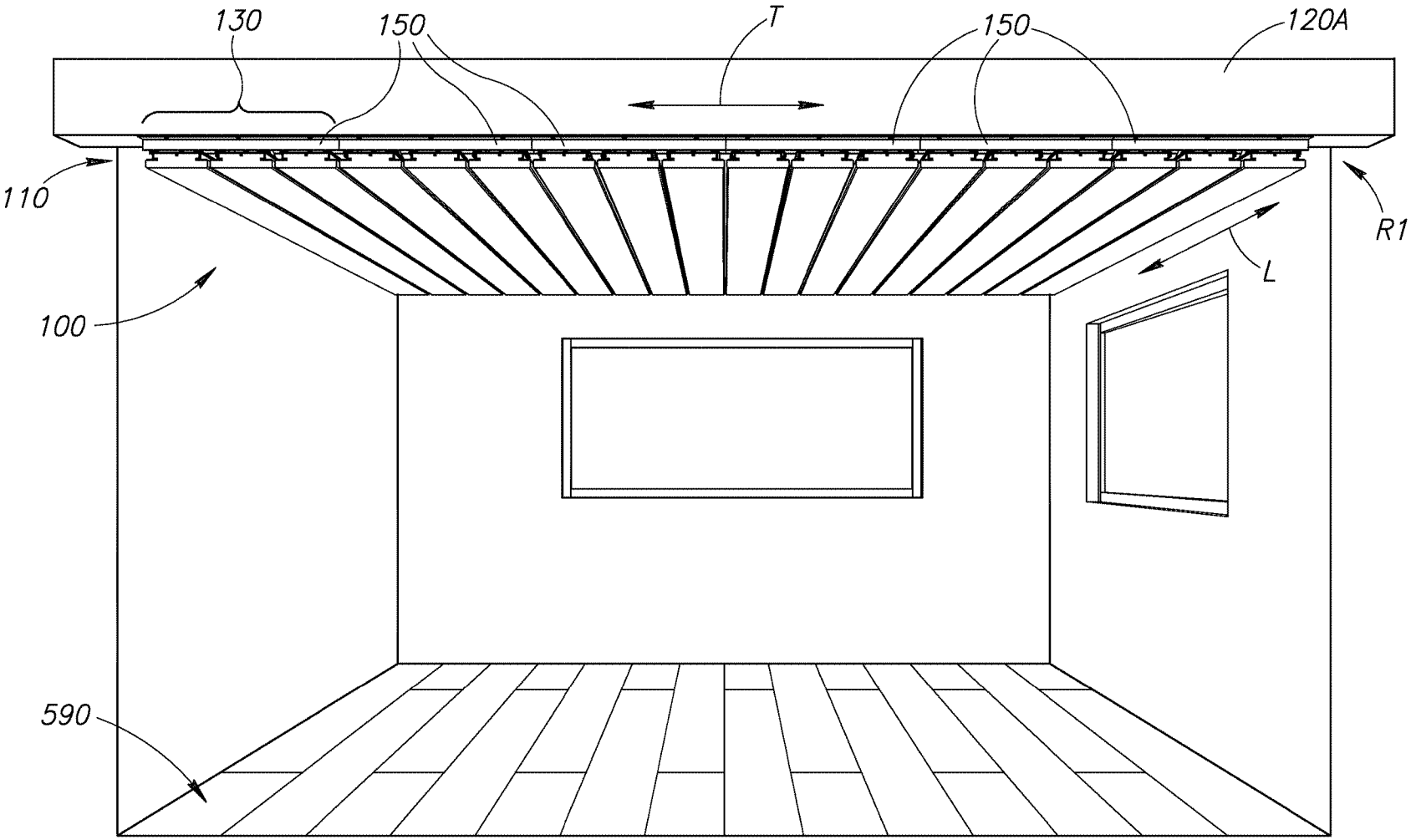
FIG. 1 is a perspective view of a room with a ceiling constructed using a system that includes a plurality of board assemblies and a plurality of mounting assemblies.
Figure 2A:
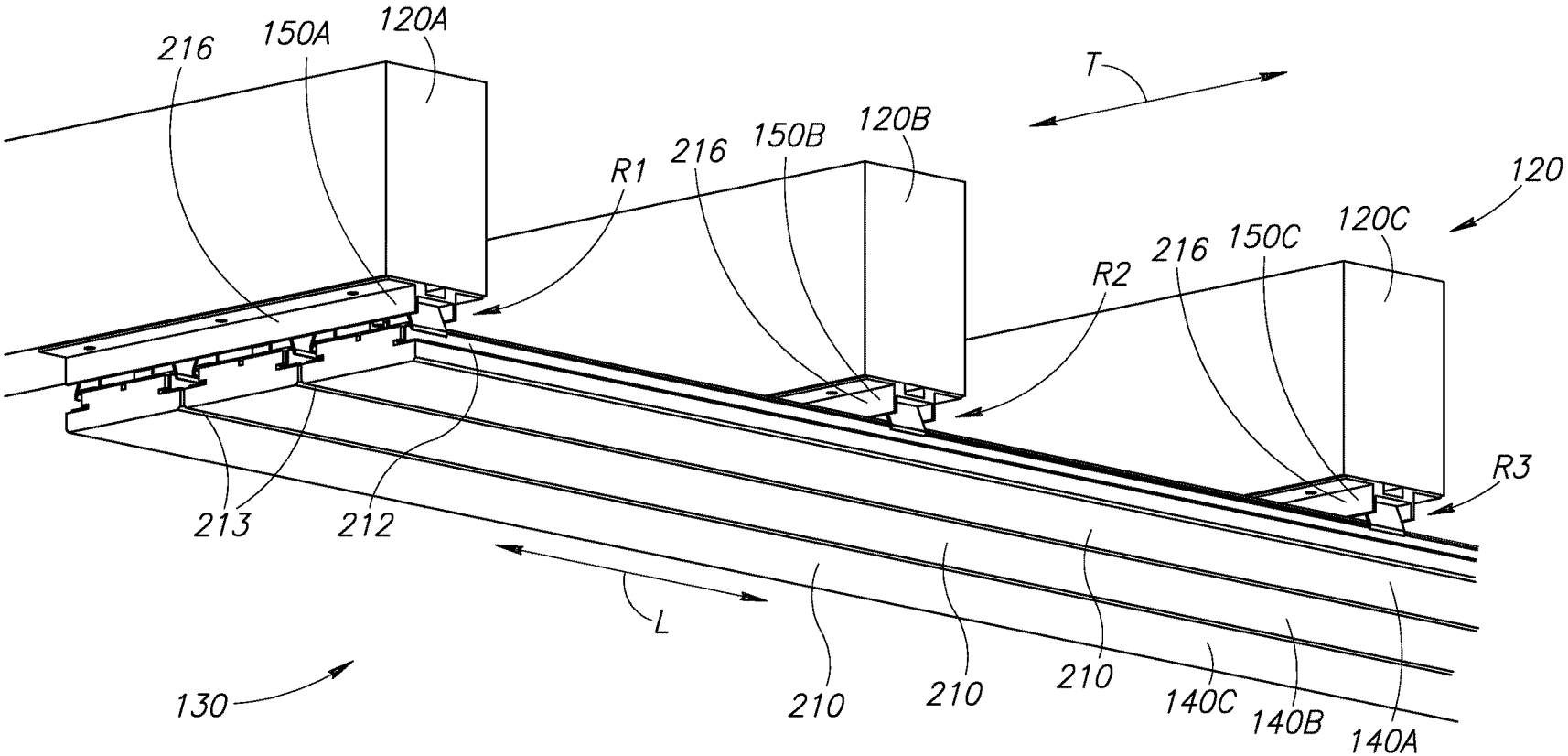
FIG. 2A is a perspective view of a portion of the ceiling of FIG. 1.
Figure 2B:
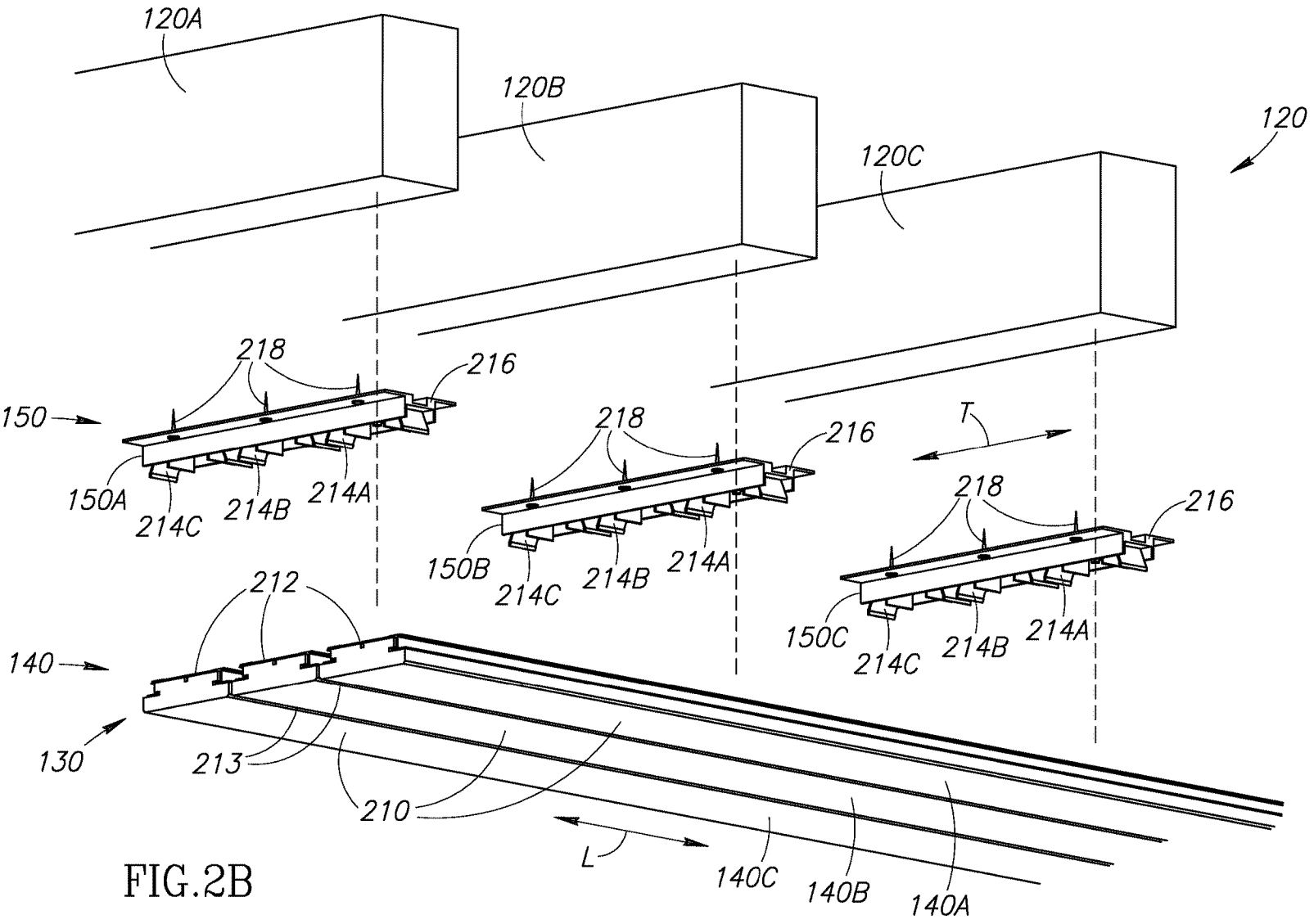
FIG. 2B is a partially exploded view of the portion of the ceiling depicted in FIG. 2A.

FIG. 1 depicts a ceiling 100 constructed at least in part using a system 110 mounted on one or more ceiling support structures 120 (see FIGS. 2A and 2B). The ceiling support structure(s) 120 may include one or more of the following: ceiling joist, floor joist, roof trusses, paneling, plywood, drywall, ceiling covering, wall covering, floor covering, and the like. For ease of illustration, the ceiling 100 will be described as having a length that extends along a longitudinal direction "L" and a width that extends along a transverse direction "T." The transverse direction "T" is substantially orthogonal to the longitudinal direction "L."

Figure 2C:
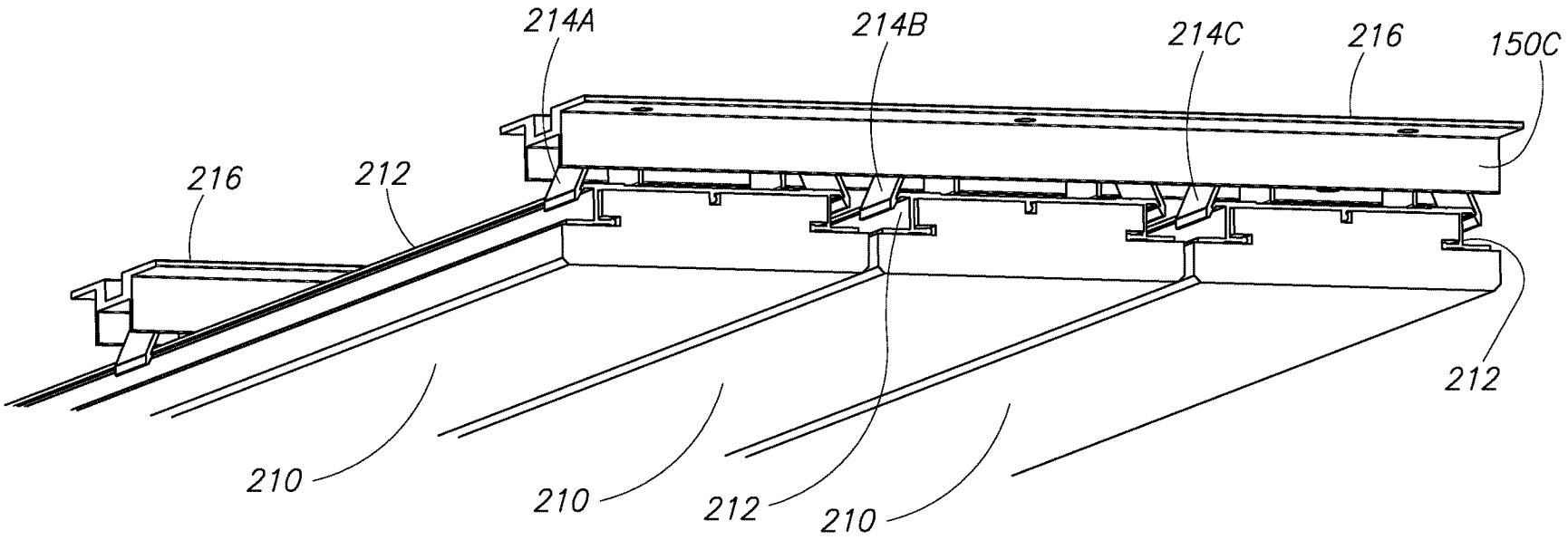
FIG. 2C is a perspective view of a second end of the portion of the ceiling depicted in FIG. 2A.
Figure 3:
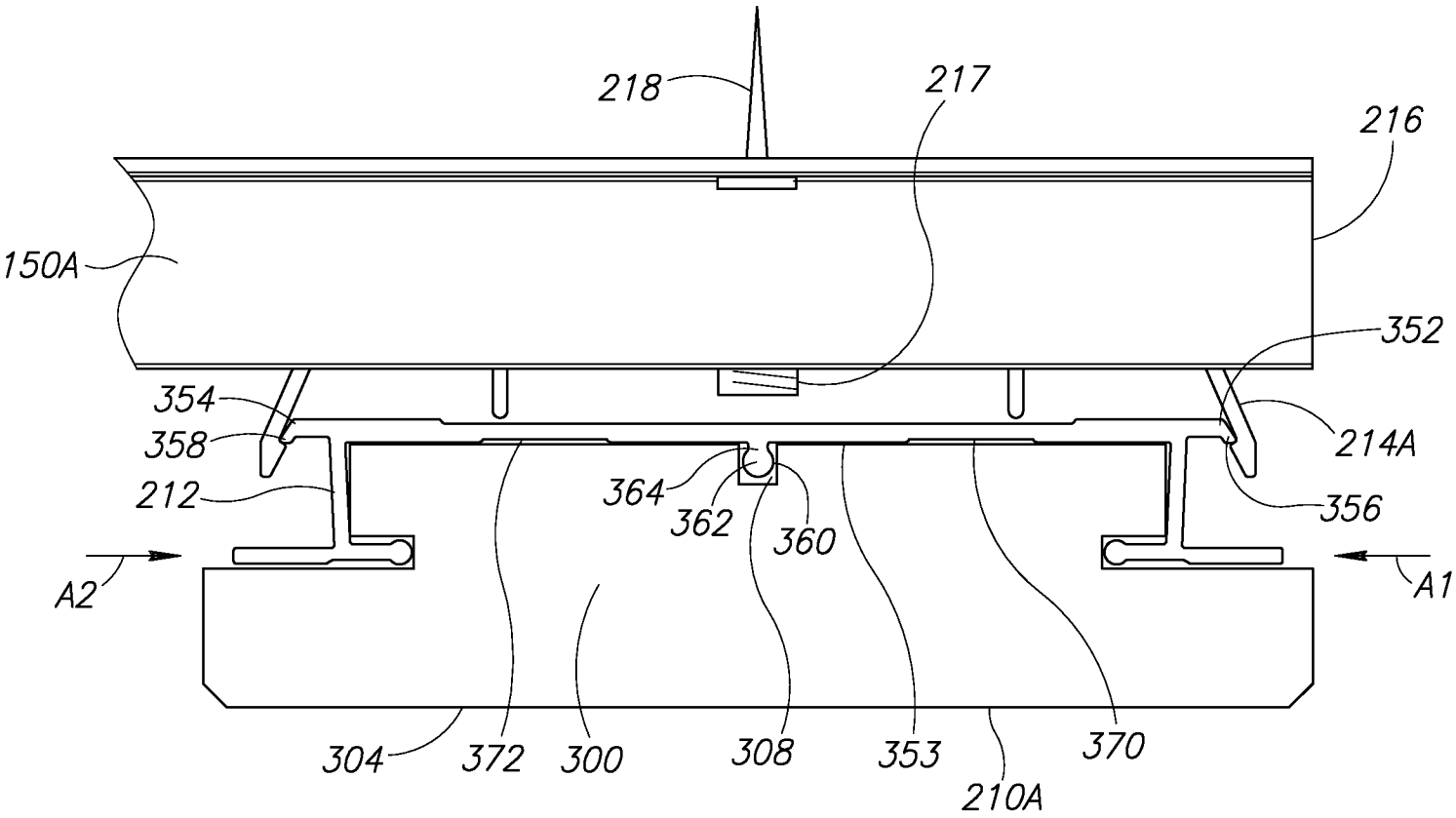
FIG. 3 is an enlarged view of a first end of one of the board assemblies clipped to one of the mounting assemblies.

FIG. 2A depicts a section 130 of the ceiling 100 (see FIG. 1). FIG. 2B is a partially exploded view of the section 130. FIG. 2C is a perspective view of an end portion of the section 130 omitting the ceiling support structure(s) 120. FIG. 3 is an enlarged end view of a portion of the section 130 omitting the ceiling support structure(s) 120.

Referring to FIG. 2A, the ceiling 100 (see FIG. 1) may include a plurality of sections like or substantially similar to the section 130. FIG. 2B is an exploded view of the section 130. Referring to FIG. 2B, the system 110 (see FIG. 1) includes a plurality of board assemblies 140 and a plurality of mounting assemblies 150. For ease of illustration, the section 130 has been illustrated as including the three board assemblies 140A-140C and the three mounting assemblies 150A-150C.

The board assemblies 140 each extend along the longitudinal direction "L," and are substantially identical to one another. However, different ones of the board assemblies 140 may have different lengths. Further, the length of one or more of the board assemblies 140 may be shortened by cutting.

Each of the board assemblies 140 includes a board 210 and a mounting member 212. The boards 210 are substantially identical to one another, and mounting members 212 are substantially identical to one another. In the ceiling 100 (see FIG. 1), the board assemblies 140 are positioned side-by-side along the transverse direction "T." Optionally, a gap 213 may be defined between adjacent pairs of the board assemblies 140. To extend the full length of the ceiling 100 (along the longitudinal direction "L"), some of the board assemblies 140 may be positioned end-to-end.

The mounting assemblies 150 each extend along the transverse direction "T." The mounting assemblies 150 each include a predetermined number of clip members 214A-214C (e.g., one, two, three, and so on) fastened to a base member 216. For ease of illustration, in FIGS. 2A-2C, 5A, and 5B, the mounting assemblies 150 have been illustrated as including three clip members. However, this is not a requirement.

Figure 5A:
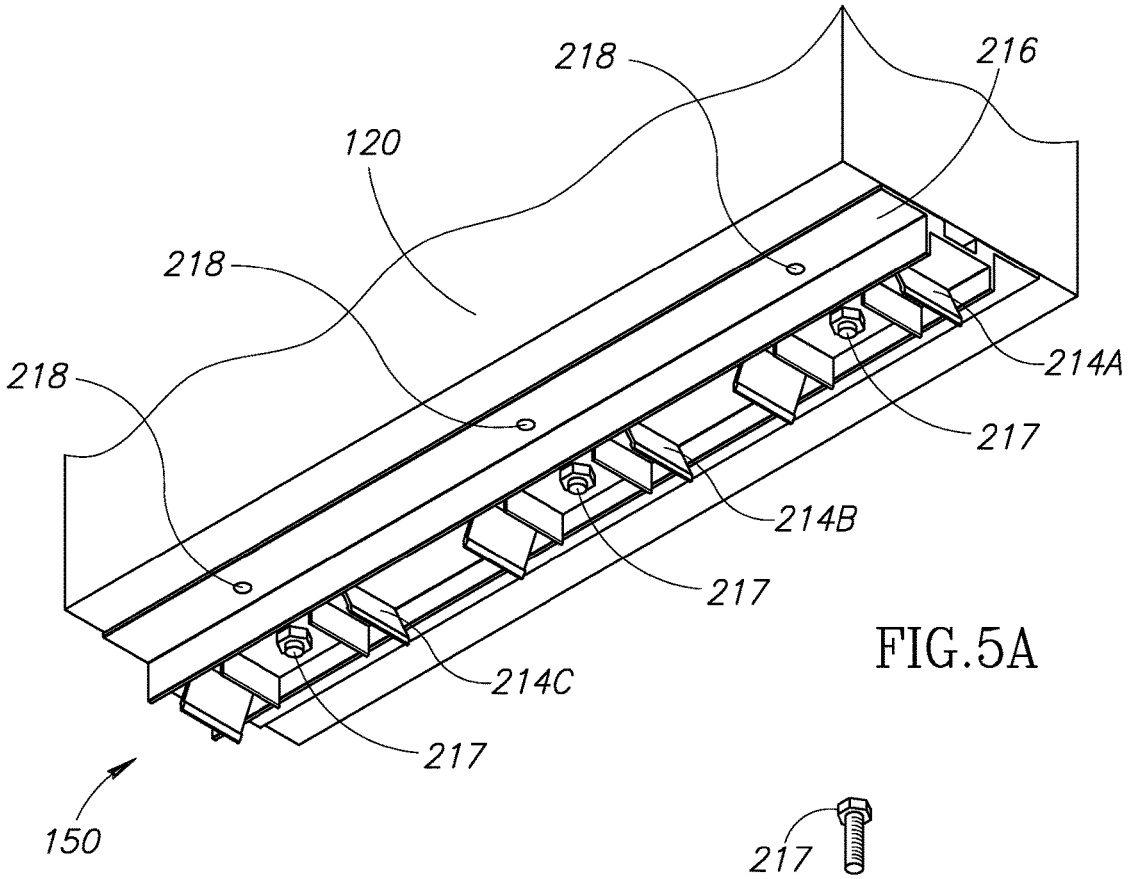
FIG. 5A is a perspective view of a front side of one of the mounting assemblies.
Figure 5B:
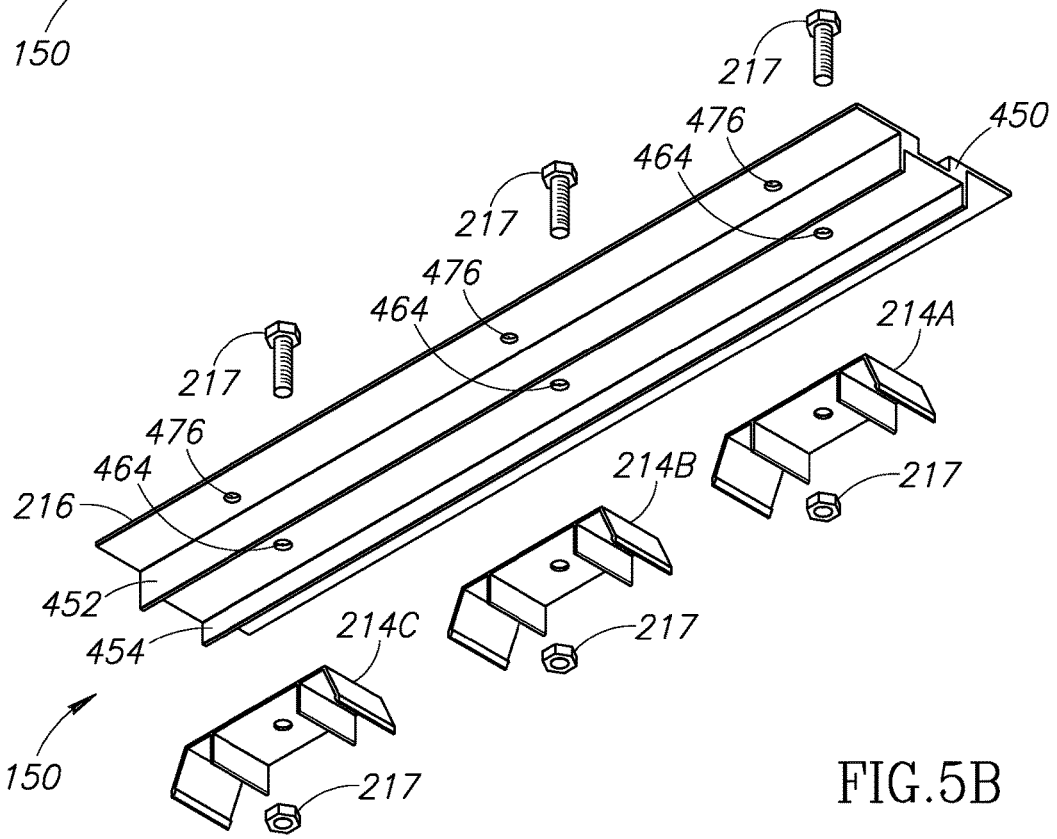
FIG. 5B is an exploded perspective view of the mounting assembly of FIG. 5A.
Figure 5C:
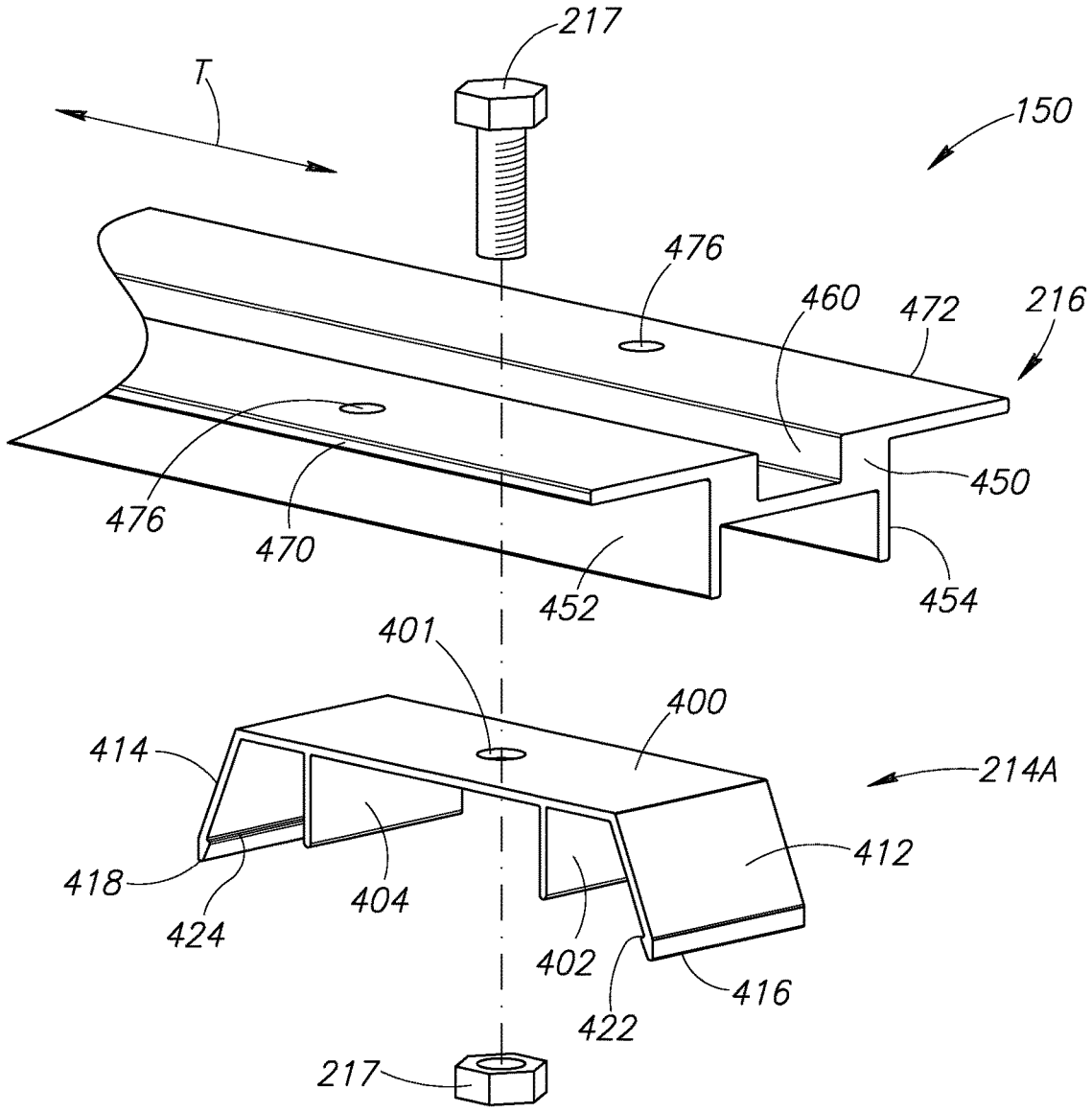
FIG. 5C is an enlargement of a portion of FIG. 5B.

The clip members 214A-214C are substantially identical to one another. Each of the clip members 214A-214C may be fastened to the base members 216 by a different fastener 217 (see FIGS. 3 and 5A-6), an adhesive, and the like. The fastener 217 may be implemented as a screw, bolt, and the like. In the embodiment illustrated, the fastener 217 has been implemented as a bolt and nut. As shown in FIGS. 5B and 5C, each of the clip members 214A-214C may be fastened to the base member 216 by a single nut and bolt in threaded engagement with one another.

Referring to FIG. 2B, the mounting assemblies 150 may each be mounted directly to the ceiling support structure(s) 120 by the fasteners 218, an adhesive, and the like. The fasteners 218 may be implemented as nails, screws, and the like.

Referring to FIG. 1, two or more different mounting assemblies 150 may be mounted end-to-end to one or more of the ceiling support structure(s) 120 (e.g., ceiling support structure 120A illustrated in FIG. 2A) to form a first row "R1." Referring to FIG. 2A, two or more different mounting assemblies 150 may be mounted end-to-end to one or more of the ceiling support structure(s) 120 (e.g., ceiling support structure 120B) to form a second row "R2." Depending upon the size of the ceiling 100 (see FIG. 1), additional rows (e.g., a row "R3") may be constructed by fastening two or more different mounting assemblies 150 to one or more of the ceiling support structure(s) 120 in a similar manner. In FIGS. 2A and 2B, each of the rows "R1" to "R3" is mounted on a separate one of the ceiling support structures 120 (e.g., ceiling support structures 120A-120C, respectively). However, this is not a requirement.

Along their lengths, the mounting members 212 (which each extend along the longitudinal direction "L") of each of the board assemblies 140 is clipped to one of the mounting assemblies 150 (see FIG. 2B)) in two or more different rows. For example, in FIG. 2A, the mounting members 212 of the board assemblies 140A-140C are each clipped to the mounting assemblies 150A-150C in rows "R1" to "R3."

Figure 4A:
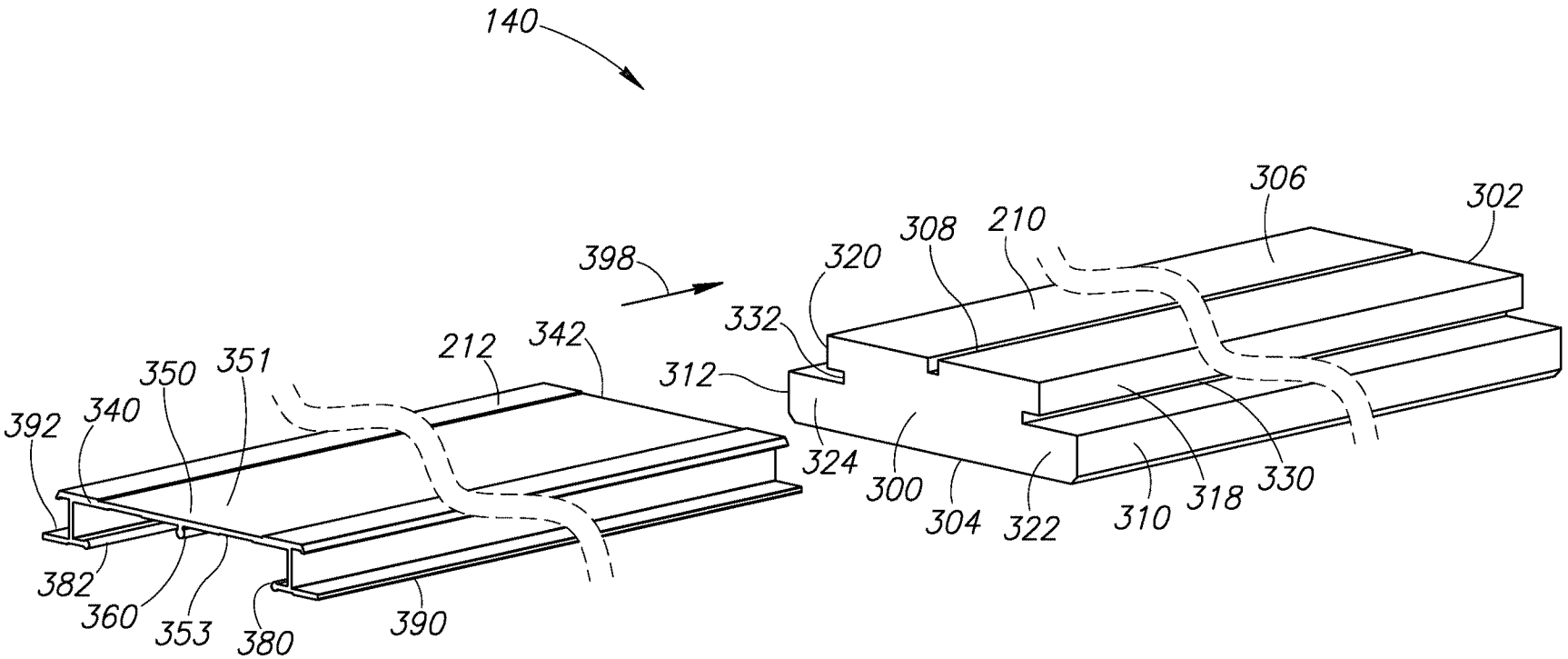
FIG. 4A is an exploded perspective view of one of the board assemblies.

Referring to FIG. 4A, as mentioned above, each of the board assemblies 140 includes the board 210 and the mounting member 212. The board 210 is elongated and has a first end 300 opposite a second end 302. The board 210 may be constructed from solid wood, a composite material (e.g., TREX® composite decking), particleboard, a laminated material, and the like.

The board 210 has an outwardly facing front side 304 opposite and inwardly facing backside 306. The front side 304 is generally planar and may be configured to provide an aesthetically desired or decorative presentation to a viewer under the ceiling 100 (see FIG. 1). The backside 306 is generally planar with a longitudinally extending center channel 308.

The board 210 has a first side 310 opposite a second side 312 that both extend between the first and second ends 300 and 302. The first and second sides 310 and 312 are mirror images of one another. The first and second sides 310 and 312 have longitudinally extending recessed portions 318 and 320, respectively, adjacent longitudinally extending overhang portions 322 and 324, respectively. A longitudinally extending first side channel 330 is positioned between the overhang portion 322 and the recessed portion 318, and a longitudinally extending second side channel 332 is positioned between the overhang portion 324 and the recessed portion 320.

The overhang portions 322 and 324 may be characterized as overhanging or concealing the mounting member 212 from the viewer under the ceiling 100 (see FIG. 1). The recessed portions 318 and 320 and the backside 306 may be characterized as being trapped or encased by the mounting member 212.

Figure 4B:
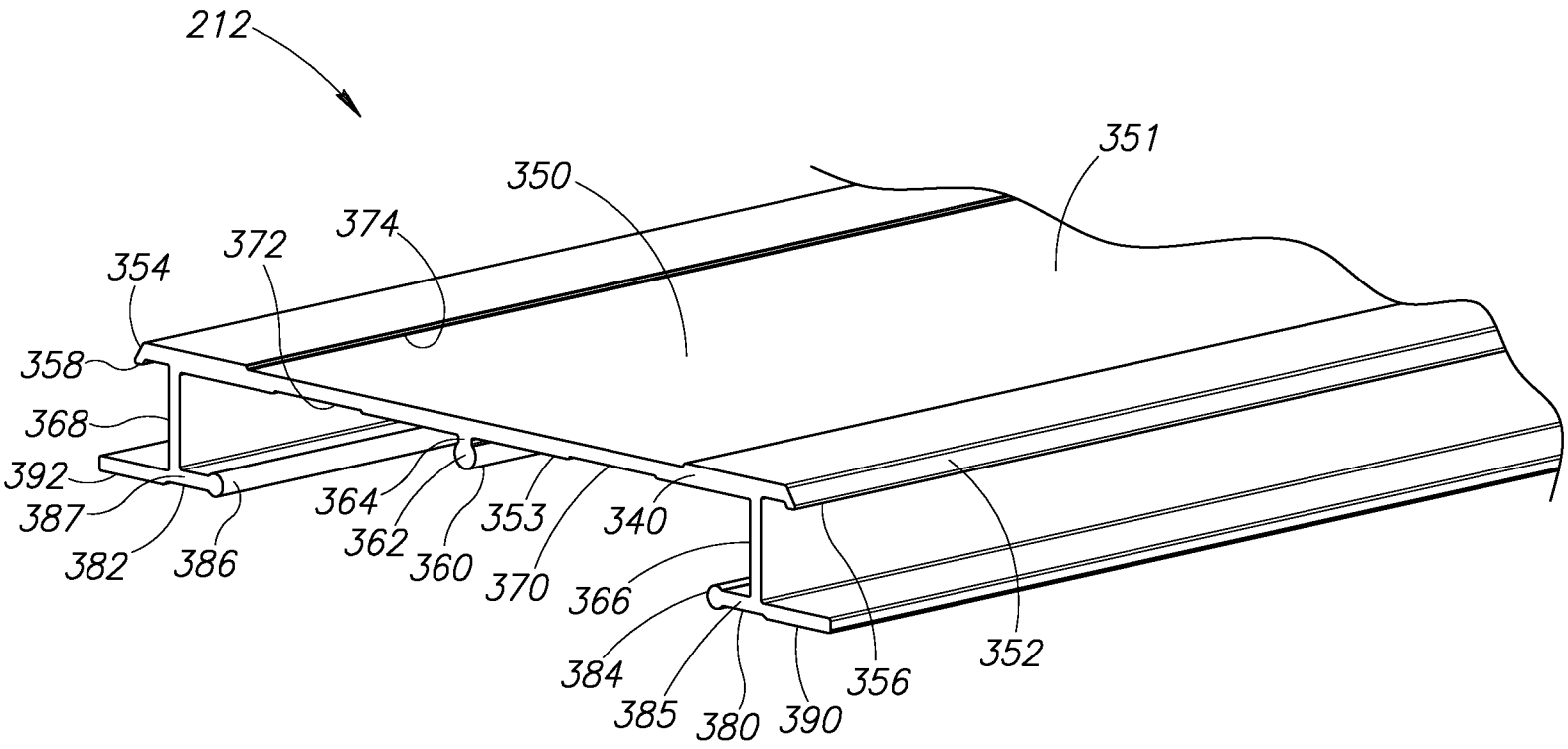
FIG. 4B is an enlarged view of a mounting member of the board assembly of FIG. 4A.

The mounting member 212 is elongated and has a first end 340 opposite a second end 342. FIG. 4B is an enlarged end view of the first end 340 of the mounting member 212. The mounting member 212 has a base portion 350 with a first side edge 352 opposite a second side edge 354. The base portion 350 has a backside 351 opposite a front side 353. Referring to FIG. 4A, the front side 353 of the base portion 350 is configured to extend alongside the backside 306 of the board 210. Referring to FIG. 3, the first and second side edges 352 and 354 are configured to clip into one of the clip members 214A-214C (e.g., the clip member 214A). Optionally, outwardly tapered flanges 356 and 358 may extend forwardly from the first and second side edges 352 and 354, respectively.

Referring to FIG. 4A, on its front side 353, the mounting member 212 has a longitudinally extending center stiffener or projection 360 configured to be received inside the center channel 308 of the backside 306 of the board 210. The center projection 360 helps prevent the board 210 from warping to thereby help keep the board 210 straight along its length.

Referring to FIG. 4B, the center projection 360 is positioned midway between the first and second side edges 352 and 354. The center projection 360 has a free distal edge portion 362 opposite a proximal portion 364 that is connected to the base portion 350. The distal edge portion 362 is wider (e.g., bulbous) than the proximal portion 364 along the transverse direction "T." Thus, referring to FIG. 3, when the free distal edge portion 362 contacts the inside of the center channel 308, air may nevertheless travel between the narrower proximal portion 364 of the center projection 360 and the inside of the center channel 308. In other words, air may flow between the center projection 360 and the inside of the center channel 308. The center projection 360 is configured to help keep the board 210 straight.

Referring to FIG. 4B, first and second spaced apart sidewalls 366 and 368 extend frontwardly from the base portion 350. The sidewalls 366 and 368 are configured to extend alongside the recessed portions 318 and 320 (see FIG. 4A), respectively, of the board 210 (see FIG. 4A). The sidewalls 366 and 368 are spaced inwardly away from the first and second side edges 352 and 354, respectively. In the embodiment illustrated, the center projection 360 is positioned midway between the sidewalls 366 and 368. In the embodiment illustrated, the first and second side edges 352 and 354 extend outwardly away from the sidewalls 366 and 368, respectively, in opposite directions.

The board 210 may expand and/or contract lengthwise and/or laterally. When this occurs, the center projection 360 limits the board's ability to expand and contract laterally and thereby helps keep the board 210 straight along its length. Specifically, expansion and contraction of the board 210 is restricted (along its first side 310) to between the center projection 360 and the first sidewall 366. Similarly, expansion and contraction of the board 210 is restricted (along its second side 312) between the center projection 360 and the second sidewall 368. This limits (to about half) lateral shift (or lengthwise deviation from straight and/or flat along its length) by the board 210 and helps prevent warping. Further, the center projection 360 provides a tighter fit for the board 210 to further restrict its movement relative to the mounting member 212.

The base portion 350 may include one or more air channels positioned to be alongside the board 210 (see FIG. 4A). In the embodiment illustrated, the front side 353 of the base portion 350 includes a longitudinally extending first air channel 370 positioned between the first sidewall 366 and the center projection 360, and a longitudinally extending second air channel 372 positioned between the second sidewall 368 and the center projection 360. The air channels 370 and 372 are positioned to extend alongside the backside 306 (see FIG. 4A) of the board 210 (see FIG. 4A). In the embodiment illustrated, the backside 351 of the base portion 350 includes a longitudinally extending third air channel 374, which will be discussed below.

A first inwardly extending flange 380 extends from the first sidewall 366 toward the second sidewall 368, and a second inwardly extending flange 382 extends from the second sidewall 368 toward the first sidewall 366. Thus, the flanges 380 and 382 extend inwardly toward one another. Referring to FIG. 4A, the first and second inwardly extending flanges 380 and 382 are configured to be received inside the first and second side channels 330 and 332, respectively, of the board 210. Thus, the back side 306 of the board 210 is trapped between the sidewalls 366 and 368, the inwardly extending flanges 380 and 382, and the base portion 350, which helps prevent the board 210 from warping to thereby help keep the board 210 straight and/or flat along its length. In other words, the board 210 is partially encased by the mounting member 212.

Like the center projection 360, the first inwardly extending flange 380 has a free distal edge portion 384 opposite a proximal portion 385 that is connected to the first sidewall 366. Similarly, the second inwardly extending flange 382 has a free distal edge portion 386 opposite a proximal portion 387 that is connected to the second sidewall 368. The distal edge portions 384 and 386 are thicker (e.g., bulbous) than the proximal portions 385 and 387, respectively, along a direction orthogonal to both the longitudinal directions "L" and the transverse direction "T." Thus, when the free distal edge portion 384 contacts the inside of the first side channel 330, air may nevertheless travel between the narrower proximal portion 385 of the first inwardly extending flange 380 and the inside of the first side channel 330. Similarly, when the free distal edge portion 386 contacts the inside of the second side channel 332, air may nevertheless travel between the narrower proximal portion 387 of the second inwardly extending flange 382 and the inside of the second side channel 332. In other words, air may flow between the first and second inwardly extending flanges 380 and 382 and the insides of the first and second side channels 330 and 332, respectively.

In the embodiment illustrated, a first outwardly extending flange 390 extends from the first sidewall 366, and a second outwardly extending flange 392 extends from the second sidewall 368. The first outwardly extending flange 390 is configured to extend along at least a portion of the underside the overhang portion 322, and the second outwardly extending flange 392 is configured to extend along at least a portion of the underside the overhang portion 324.

The base portion 350, the center projection 360, the sidewalls 366 and 368, and the flanges 380, 382, 390, and 392 help prevent the board 210 from twisting or otherwise warping thereby helping to keep the board 210 substantially planar and straight along its length. In other words, the mounting member 212 constrains the movement of the board 210 to maintain the board 210 in a desired substantially planar and straight shape.

Referring to FIG. 4A, as mentioned above, before installation in the ceiling 100 (see FIG. 1), the mounting member 212 is slid onto the board 210. This may occur immediately after the board 210 is milled. At the first end 300 of the board 210, the center projection 360 of the mounting member 212 is aligned with the center channel 308, the flanges 380 and 382 of the mounting member 212 are aligned with the channels 330 and 333, respectively, and the flanges 390 and 392 of the mounting member 212 are aligned with the undersides of the overhang portions 322 and 324, respectively. Then, the mounting member 212 is slid (in a direction identified by an arrow 398) and/or the board 210 is slid (in a direction opposite the direction identified by the arrow 398) until the mounting member 212 is adjacent the board 210 and does not extend beyond the second end 302 of the board 210.

The sidewalls 366 and 368 may be flexed or deflected outwardly so that the board 210 may be received therebetween. Then, after the board 210 has been received, the sidewalls 366 and 368 may flex or deflect inwardly to trap the board 210.

The inwardly extending flanges 380 and 382 press inwardly (in directions identified by arrows "A1" and "A2" in FIG. 3) or clamp onto the board 210. This pressing and/or friction between the board 210 and the mounting member 212 help prevent the board 210 from moving relative to the mounting member 212. In the embodiment illustrated, the mounting member 212 grips the board 210 and prevents it from moving relative to the mounting member 212.

Because the mounting member 212 helps keep the board 210 straight, the board 210 may be longer than board conventionally used to construct ceilings, decks, floors, walls, and the like. Additionally, the board 210 need not be continuous. Instead, a plurality of board sections each like the board 210 may be arranged end-to-end and inserted into the mounting member 212.

In the embodiment illustrated, the mounting member 212 has a length that is substantially equal to the length of the board 210. However, this is not a requirement. In alternate embodiments, the mounting member 212 may have a length that is less than the length of the board 210. Further, the mounting member 212 has been described as being a single unit that extends continuously along the length of the board 210. In alternate embodiments, the mounting member 212 may be implemented as a plurality of like members spaced apart longitudinally along the board 210 that together extend in a discontinuous manner along at least a portion of the length of the board 210.

As mentioned above, the mounting assemblies 150 each include the clip members 214A-214C (e.g., one, two, three, and so on) and the base member 216. The clip members 214A-214C are substantially identical to one another. Therefore, only the clip member 214A will be described in detail. As shown in FIG. 3, the mounting member 212 is pressed into the clip member 214A, which is configured to grip the mounting member 212 and prevent the board assembly 140 from falling from the ceiling 100 (see FIG. 1).

Referring to FIG. 5C, the clip member 214A has a substantially planar base portion 400 configured to abut and be fastened by one of the fasteners 217 (e.g., a bolt and nut) to the base member 216. At least one through-hole 401 is formed in the base portion 400. Each through-hole 401 is configured to receive one of the fasteners 217.

In the embodiment illustrated, first and second stops or spacers 402 and 404 extend frontwardly from the base portion 400. The first and second spacers 402 and 404 are spaced apart from one another and positioned to abut the base portion 350 (see FIGS. 4A and 4B) of the mounting member 212 (see FIGS. 2A-4B) when the mounting member 212 is clipped to the clip member 214A. The first and second spacers 402 and 404 are spaced apart along the transverse direction "T." In the embodiment illustrated, the through-hole 401 is positioned between the first and second spacers 402 and 404 and at least a portion of the fastener 217 (e.g., the threaded end of the bolt and the nut) is positionable between the first and second spacers 402 and 404.

First and second angled sidewalls 412 and 414 extend frontwardly and outwardly from the base portion 400. The first and second angled sidewalls 412 and 414 are spaced outwardly from the spacers 402 and 404, respectively, along the base portion 400. The first and second angled sidewalls 412 and 414 are configured to flex or deflect outwardly to allow the first and second side edges 352 and 354 (see FIGS. 3 and 4B) of the mounting member 212 to pass therebetween. The first and second angled sidewalls 412 and 414 have first and second free edges 416 and 418, respectively. First and second inwardly extending gripping projections 422 and 424 are positioned at or near the first and second free edges 416 and 418, respectively. The first and second angled sidewalls 412 and 414 flex or deflect outwardly when the mounting member 212 is inserted therebetween to allow the first and second side edges 352 and 354 (see FIGS. 3 and 4B) to pass alongside the gripping projections 422 and 424, respectively. After the first and second side edges 352 and 354 have cleared the gripping projections 422 and 424, respectively, the first and second angled sidewalls 412 and 414 return to their original (un-flexed) positions to trap the first and second side edges 352 and 354 (and the mounting member 212) inside the clip member 214A. The outwardly tapered flanges 356 and 358 (see FIGS. 3 and 4B) may be shaped to help deflect the first and second angled sidewalls 412 and 414, respectively, outwardly as the mounting member 212 is pressed into the clip member 214A.

The base member 216 has a base portion 450. Spaced apart first and second side rails 452 and 454 extend frontwardly from the base portion 450. The first and second side rails 452 and 454 extend in the transverse direction "T." Further, the first and second side rails 452 and 454 are spaced apart from one another in the longitudinal direction "L" (see FIGS. 1-2B).

Referring to FIG. 5B, the base portion 450 includes at least one through-hole 464 for each of the clip members 214A-214C mounted to the base member 216. Each through-hole 464 is configured to receive one of the fasteners 217. The through-holes 464 are positioned between the first and second side rails 452 and 454. Referring to FIG. 5C, a groove 460 may be formed in the base portion 450. In such embodiments, the through-holes 464 (see FIG. 5B) are positioned inside the groove 460, which is configured to recess portions (e.g., bolt heads) of the fasteners 217 so that the base portion 450 may be flush mounted to the ceiling support structure(s) 120.

Referring to FIG. 5C, in the embodiment illustrated, the groove 460 is configured to prevent the fasteners 217 from being rotated therein relative to the base member 216. Specifically, the fasteners 217 are each implemented as bolt having a bolt head connected to a threaded portion that is configured to be threaded into a corresponding nut. The groove 460 is sufficiently wide (along the longitudinal direction "L") to receive the bolt heads but not wide enough to allow the bolt heads to be turned or rotated. Thus, the nuts may be readily threaded onto the threaded portions of the bolts after the base member 216 has been fastened to one or more of the ceiling support structures 520 (see FIG. 5A).

A first flange 470 extends outwardly from the base portion 450 in a first direction substantially parallel with the longitudinal direction "L" (see FIG. 1-2B) and a second flange 472 extends outwardly from the base portion 450 in a second direction opposite the first direction. The first and second flanges 470 and 472 each include a plurality of through-holes 476. Each through-hole 476 is configured to receive one of the fasteners 218 (see FIGS. 2B, 3, and 5A).

Figure 6:
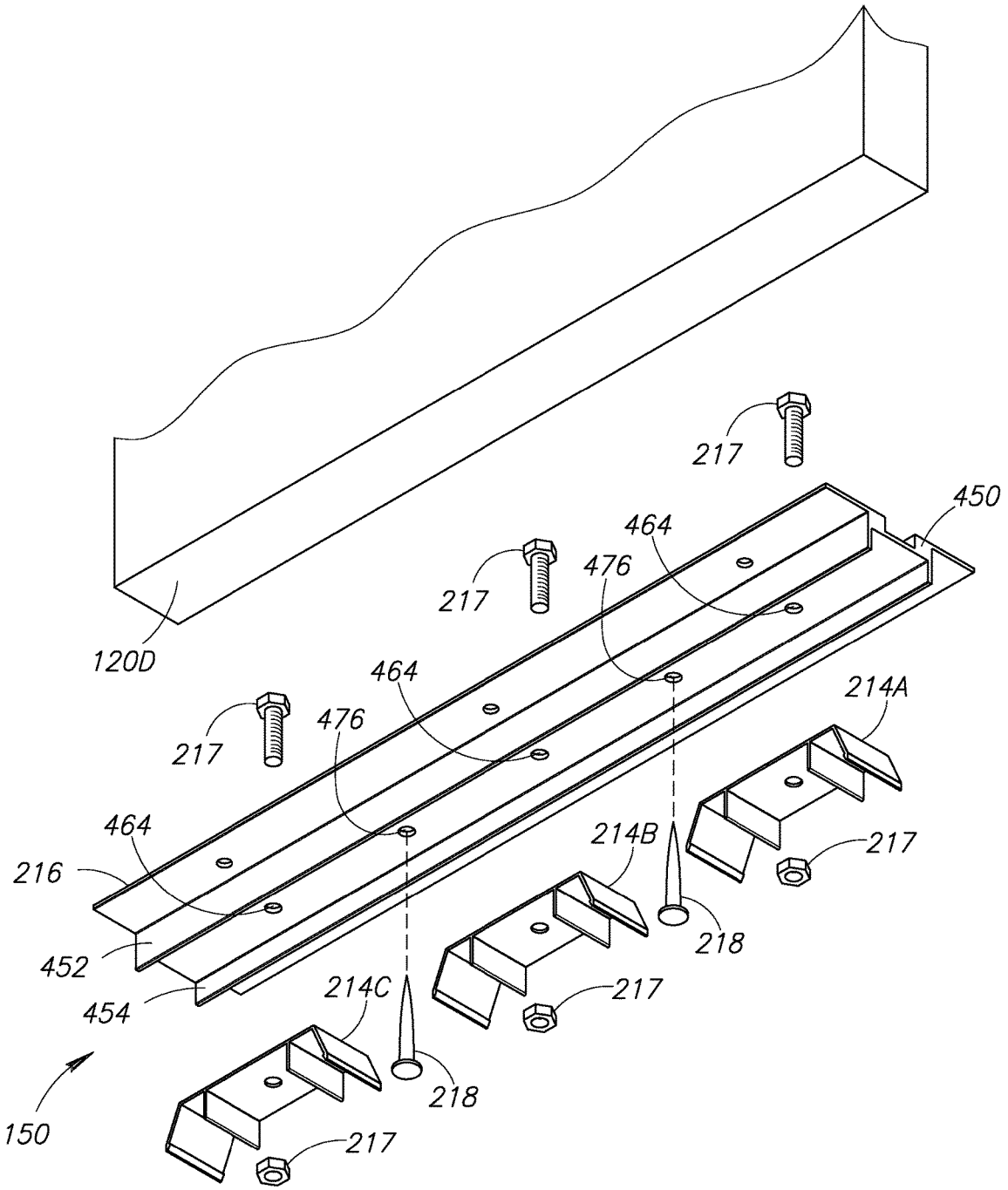
FIG. 6 is an exploded perspective view of a front side of a mounting assembly configured to be mounted to a narrower ceiling support structure.

Referring to FIG. 6, optionally, the base member 216 may be configured for use with a narrower ceiling support structure 120D. In such embodiments, at least some of the through-holes 476 may be positioned between the first and second side rails 452 and 454 and within the groove 460. Further, the flanges 470 and 472 (see FIG. 5C) may be omitted. The through-holes 476 positioned between the first and second side rails 452 and 454 may be positioned between or under the clip members 214A-214C. The through-holes 476 may each include a countersink (not shown) configured to recess heads of the fasteners 218. For example, if the through-holes 476 are positioned under the clip members 214A-214C, the heads of the fasteners 218 may be recessed inside the through-holes 476 so that the clip members 214-214C may be mounted flush against the base member 216. In such embodiments, the fasteners 218 may be implemented as flat head screws (e.g., 82 degree screws).

Referring to FIG. 2B, individual ones of the board assemblies 140 may be clipped to and unclipped from the mounting assemblies 150 as desired. Any unclipped ones of the board assemblies 140 may be reused and optionally refinished. Optionally, the board assemblies 140 may be recycled.

In alternate embodiments, the system 110 may be used to construct a wall, instead of the ceiling 100 (see FIG. 1). In such embodiments, the mounting assemblies 150 are attached to one or more wall support structures (e.g., wall studs, drywall, plywood, paneling, etc.) instead of the ceiling support structure(s) 120. Then, the board assemblies 140 are clipped to the mounting assemblies 150. In such embodiments, the front sides 304 (see FIGS. 3 and 4A) of the boards 210 (see FIG. 2A-4A) may be configured to provide an aesthetically desired or decorative presentation to a viewer alongside a wall constructed using the board assemblies 140.

The components of the system 110 may be assembled into a kit. Such a kit may include the board assemblies 140 and the mounting assemblies 150. Optionally, the kit may include the fasteners 217 and/or the fasteners 218.

Figure 7:
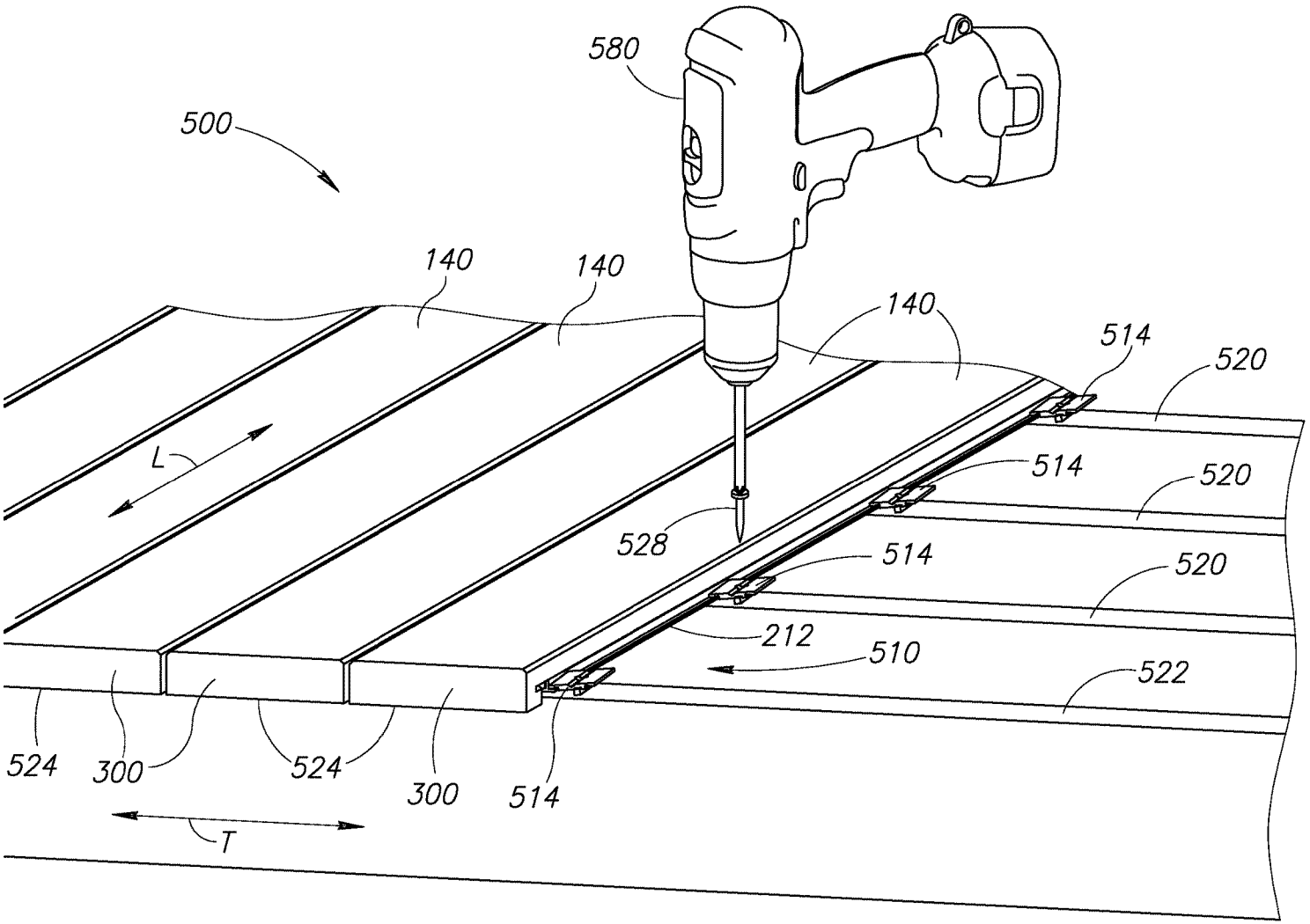
FIG. 7 is a perspective view of a deck constructed using a system that includes a plurality of the board assemblies and a plurality of clip members.

FIG. 7 depicts a deck 500 being constructed at least in part using a system 510 mounted on one or more conventional deck support structures 520. The deck support structures 520 may include floor joist, deck joist, plywood, underlayment, and the like. The deck support structures 520 include one or more outer or peripheral deck support structures 522 configured to support an outer edge of the deck 500. For ease of illustration, the deck 500 will be described as having a length that extends along the longitudinal direction "L" and a width that extends along the transverse direction "T." The deck support structures 520 illustrated in FIG. 7 each extend along the transverse direction "T." However, others of the deck support structures 520 may extend in other directions.

The system 510 includes a plurality of the board assemblies 140 and a plurality of clip members 514. In the deck 500 (see FIG. 7), the board assemblies 140 are positioned side-by-side along the transverse direction "T." To extend the full length of the deck 500, some of the board assemblies 140 may be positioned end-to-end. In the system 510, the board assemblies 140 are rotated 180° from their orientation in the system 110 (see FIG. 1) used to construct the ceiling 100 (see FIG. 1).

The mounting members 212 of the board assemblies 140 each rests against (and is clipped to) one or more of the deck support structures 520. As mentioned above, each of the mounting members 212 includes the longitudinally extending third air channel 374 (see FIGS. 4B, 8, and 12A). The third air channel 374 allows air to flow in between the mounting member 212 and those of the deck support structures 520 upon which the board assembly 140 rests.

Figure 8:
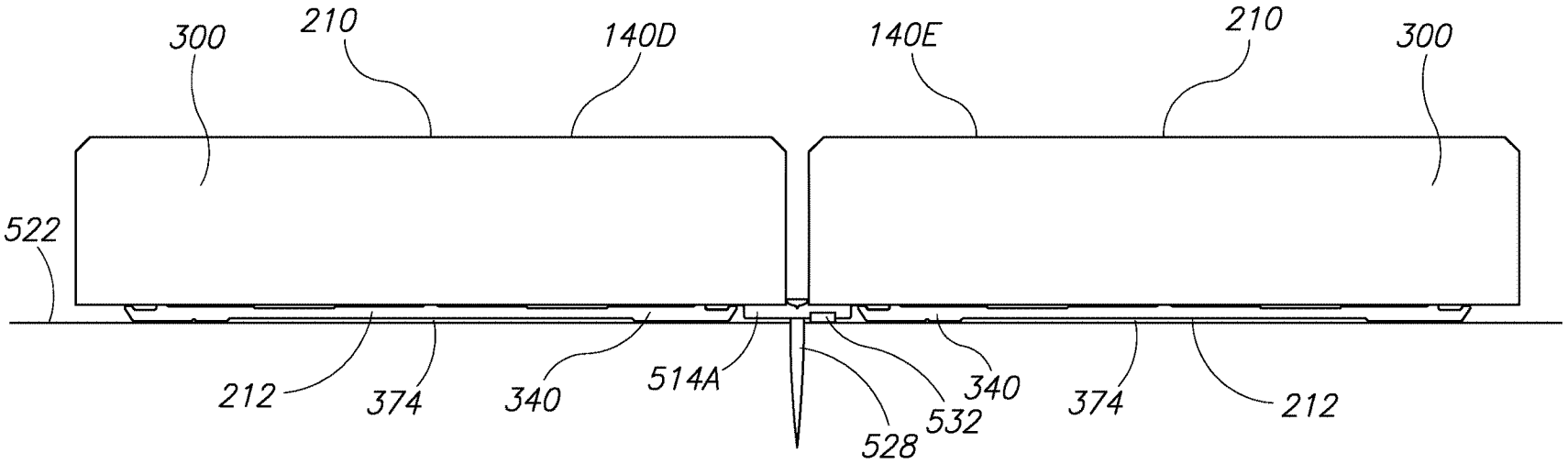
FIG. 8 is an enlarged view of a first end of a portion of the deck of FIG. 7 including a pair of adjacent board assemblies coupled to a deck support structure by one of the clip members and a fastener.
Figure 9:
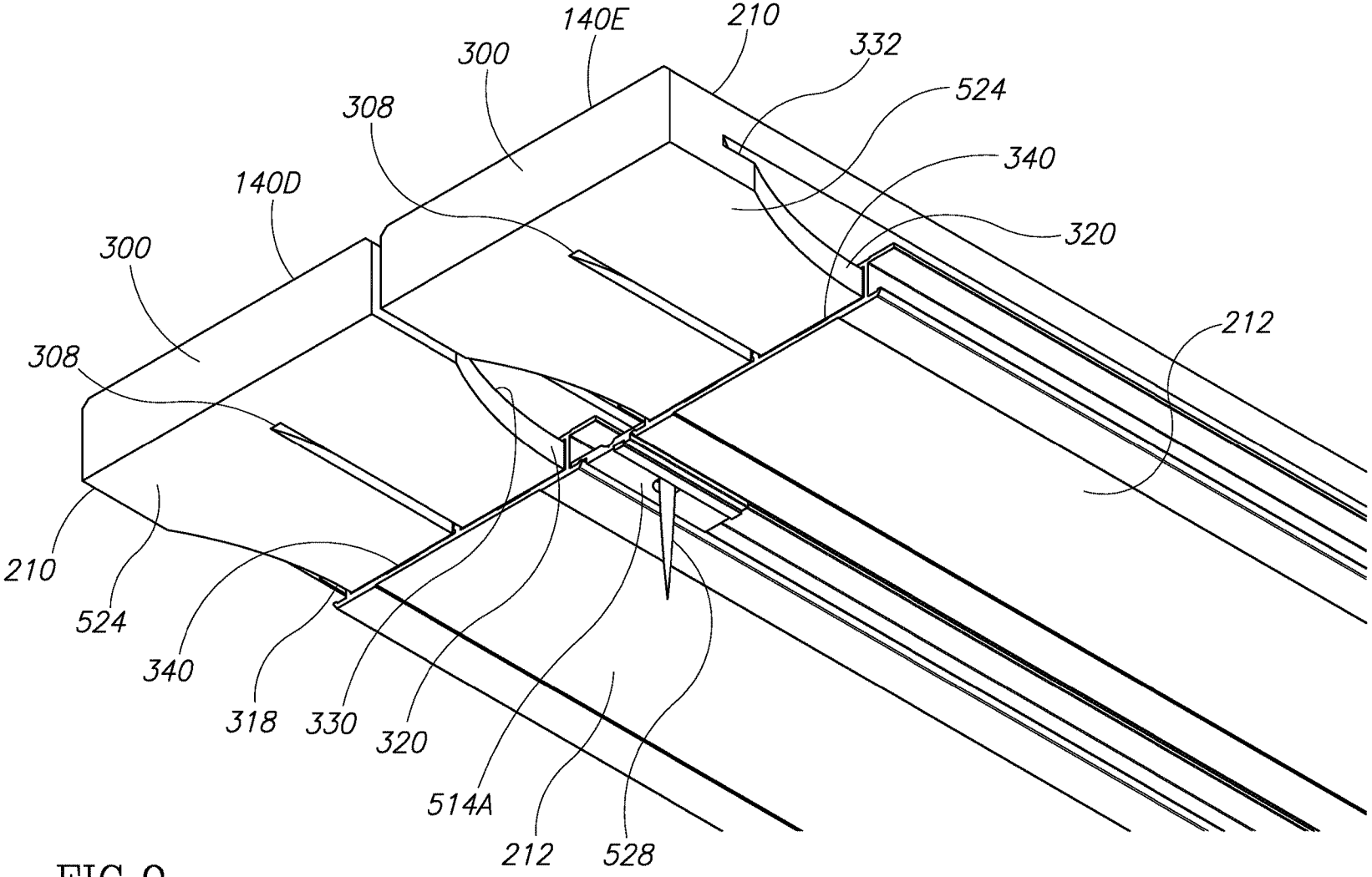
FIG. 9 is a perspective view of an underside of the pair of adjacent board assemblies and the clip member depicted in FIG. 8 in which the deck support structure has been omitted.

FIG. 8 is an end view of a portion of the deck 500 (see FIG. 7) looking toward one of the peripheral deck support structures 522. For ease of illustration, in FIG. 8, all of the board assemblies 140 (see FIG. 7) and the clip members 514 (see FIG. 7) have been omitted except for the side-by-side (or adjacent pair of) board assemblies 140D and 140E and the clip member 514A that connects them together. FIG. 9 is a view of the undersides of the board assemblies 140D and 140E coupled together by the clip member 514A. For ease of illustration, the deck support structure(s) 520 have been omitted from FIG. 9.

In the embodiment illustrated in FIG. 9, the first ends 300 of the boards 210 of the board assemblies 140 (e.g., the board assemblies 140D and 140E) include an overhang portion 524 (see FIGS. 7, 9, and 10) that extends outwardly beyond the first ends 340 of the mounting members 212. The overhang portions 524 are configured to overhang the outer deck support structure 522 (see FIGS. 7 and 9) and at least partially hide the first ends 340 of the mounting members 212 from view. As shown in FIG. 9, the center channel 308, the recessed portions 318 and 320 and the side channels 330 and 332 (see FIGS. 4A and 9) terminate before the overhang portions 524. Thus, from the first end 300, the boards 210 approximate the appearance of conventional deck boards.

Figure 10:
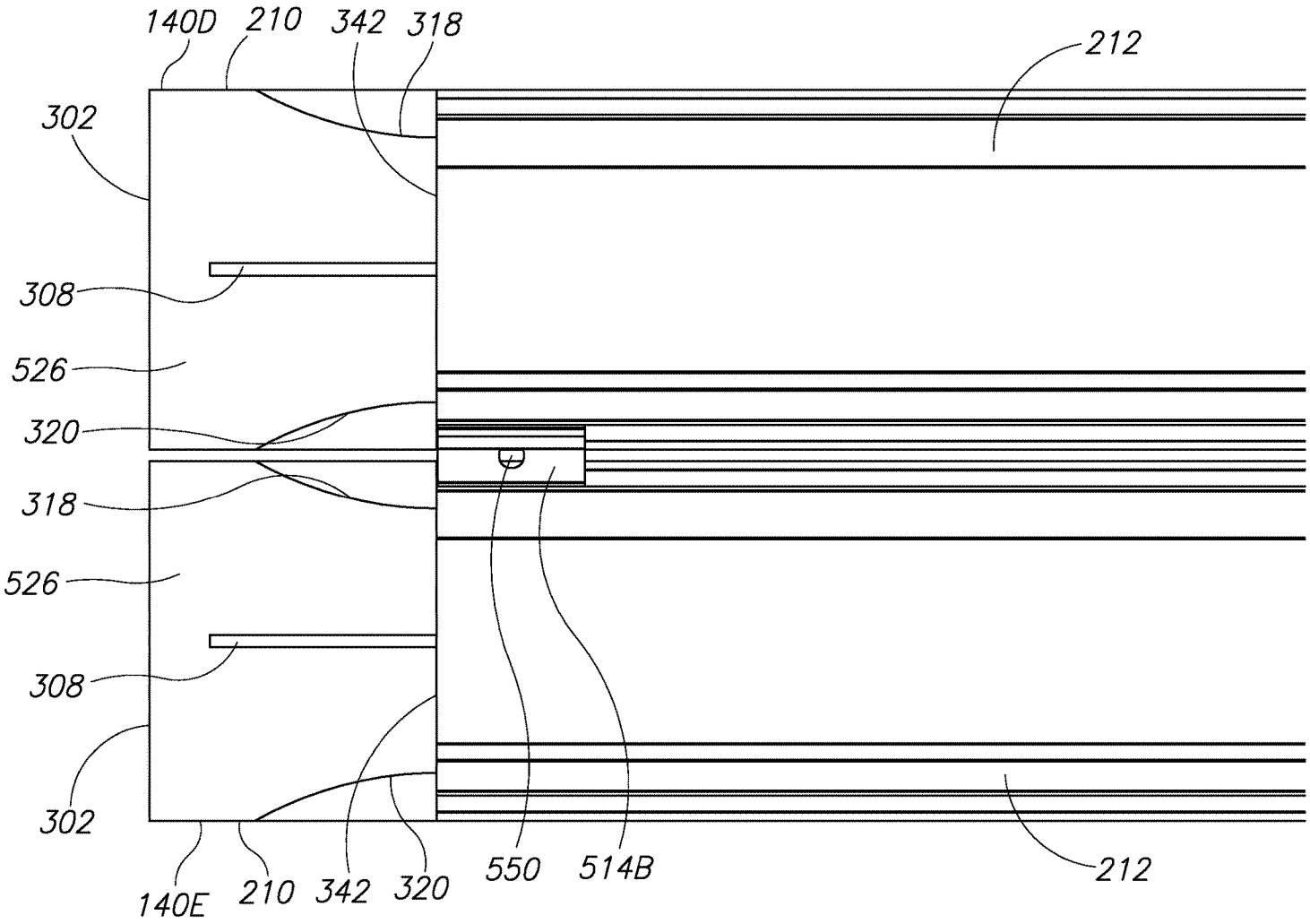
FIG. 10 is a view of the underside of the pair of adjacent board assemblies and the clip member depicted in FIG. 8 in which the deck support structure and the fastener have both been omitted.

Optionally, referring to FIG. 10, the second ends 302 of the boards 210 of some or all of the board assemblies 140 (e.g., the board assemblies 140D and 140E) may include an overhang portion 526 that is substantially identical to the overhang portion 524 (see FIG. 9) and extends outwardly beyond the second ends 342 of the mounting members 212 in a similar manner. Further, the center channel 308, the recessed portions 318 and 320 and the side channels 330 and 332 (see FIGS. 4A and 9) terminate before the overhang portion 526. Thus, from the second end 302, the boards 210 approximate the appearance of conventional deck boards.

Referring to FIG. 7, along its length, each of the board assemblies 140 is clipped to one or more of the deck support structures 520 and an adjacent one of the board assemblies 140 by one or more of the clip members 514. The clip members 514 may be fastened to the deck support structures 520 by fasteners 528 (e.g., nails, screws, and the like), an adhesive, and the like. In the embodiment illustrated, the fasteners 528 have been implemented as deck screws.

Figure 11:
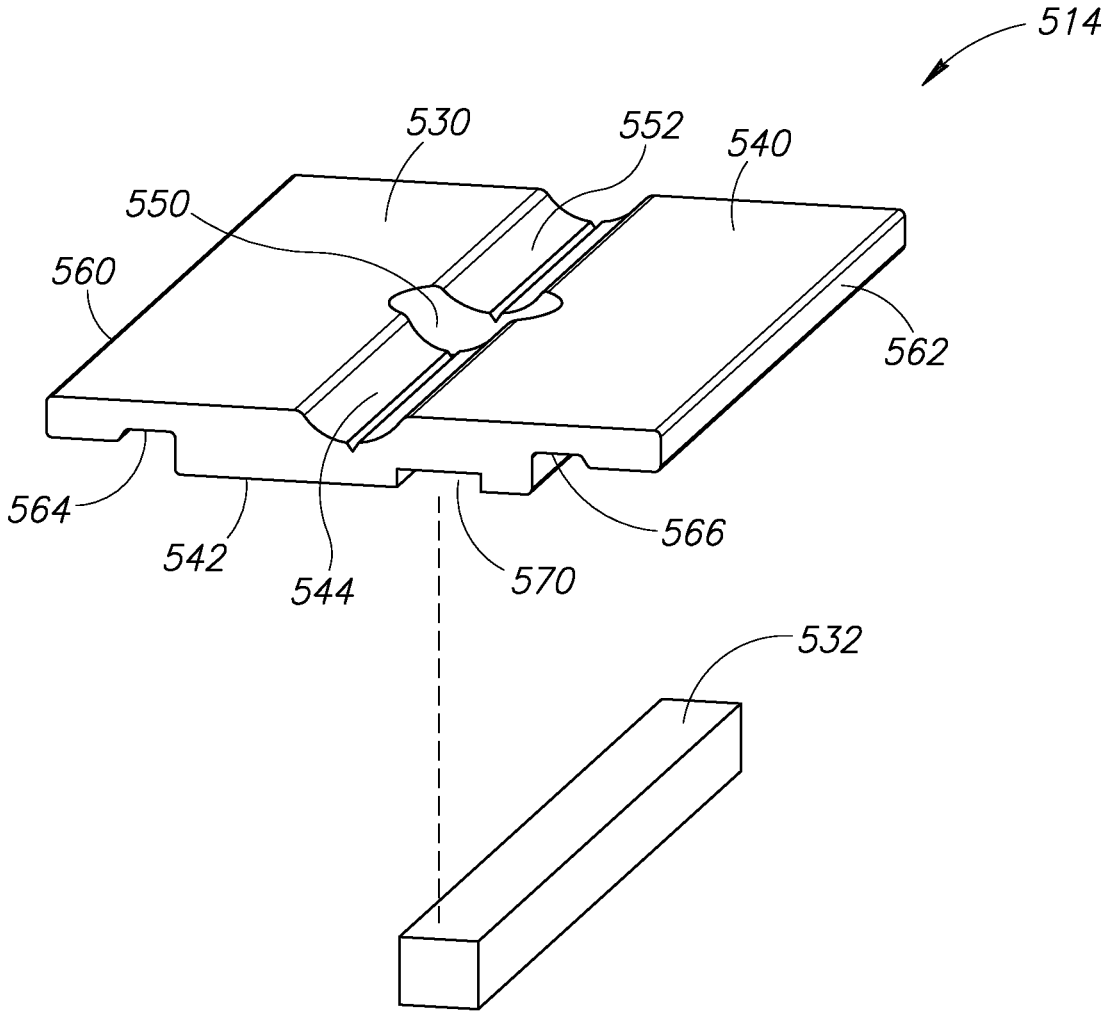
FIG. 11 is an exploded perspective view of the clip member.

The clip members 514 are substantially identical to one another. Referring to FIG. 11, each of the clip members 514 has a rigid clip body 530 and a compressible spacer member 532. The clip body 530 has a front side 540 opposite a backside 542. When the clip 514 is attached to two of the board assemblies 140 (see FIGS. 9 and 10), a portion 544 of the front side 540 is visible and accessible from above between the two board assemblies 140. The portion 544 includes a through-hole 550 that extends between its front and back sides 540 and 542. The through-hole 550 is configured to receive one of the fasteners 528 (see FIGS. 7-9 and 12B) from above and between the two adjacent board assemblies 140D and 140E (see FIGS. 8-10 and 12A-12C). Thus, the spacing along the transverse direction "T" (see FIG. 7) between the adjacent board assemblies 140D and 140E (see FIGS. 8-10 and 12A-12C) is adequate to accommodate the fastener 528 passing therethrough. In the embodiment illustrated, the through-hole 550 is positioned inside a groove 552 formed in the portion 544. The groove 552 extends along the front side 540 and is substantially parallel with the two adjacent board assemblies 140D and 140E.

Figure 12A:
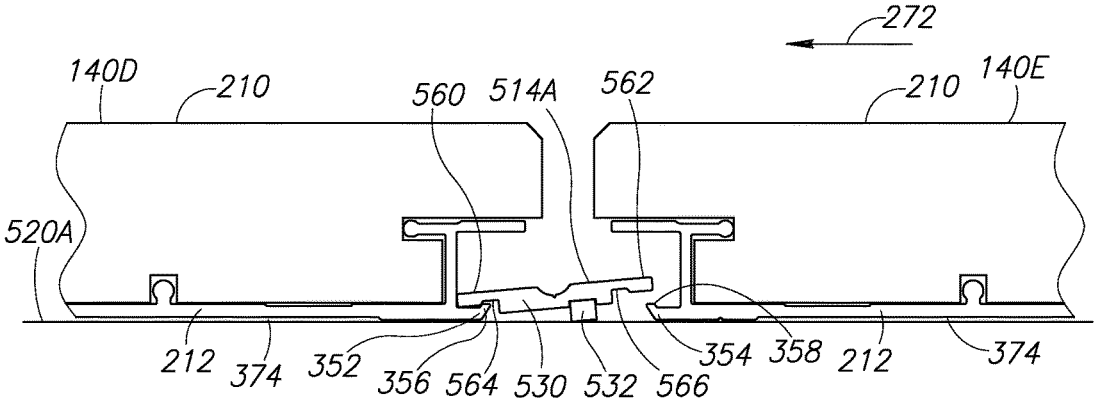
FIG. 12A is cross-sectional view of the clip member resting on a first board assembly and a deck support structure before the clip member is fastened to the deck support structure.

The clip members 514 each include first and second laterally extending overhang portions 560 and 562. A first groove 564 extends along the first overhang portion 560, and a second groove 566 extends along the second overhang portion 562. Referring to FIG. 12A, the first and second grooves 564 and 566 are substantially parallel with the adjacent board assemblies 140D and 140E (see FIGS. 8-10 and 12A-12C) that are connected together by the clip member 514. The first groove 564 is configured to receive and retain the first side edge 352 of the mounting member 212 of the board assembly 140D, and the second groove 566 is configured to receive and retain the second side edge 354 of the mounting member 212 of the board assembly 140E. In the embodiment illustrated, the outwardly tapered flange 356 of the mounting member 212 of the board assembly 140D extends upwardly into and is trapped by the first groove 564, and the outwardly tapered flange 358 of the mounting member 212 of the board assembly 140E extends upwardly into and is trapped by the second groove 566.

Referring to FIG. 11, a channel 570 is formed in the backside 542 of the clip member 514. The channel 570 is substantially parallel with the two adjacent board assemblies 140D and 140E (see FIGS. 8-10 and 12A-12C) that are connected together by the clip member 514. The channel 570 is off-center and positioned nearer the second overhang portion 562 than the first overhang portion 560. The channel 570 is configured to house the spacer member 532. In the embodiment illustrated, the spacer member 532 has a rectilinear cross-sectional shape (e.g., square, rectangular, trapezoidal, and the like) and extends the entire length of the channel 570. However, these are not requirements.

When the spacer member 532 is sufficiently compressed, the back side 542 of the clip member 514 is positioned nearer the one or more deck support structures 520 under the clip member 514, and the second groove 566 receives and traps the second side edge 354 (optionally including the outwardly tapered flange 358) of the mounting member 212 of the board assembly 140E. However, when the compressible spacer member 532 is less than sufficiently compressed, the spacer member 532 spaces the second overhang portion 562 forwardly away from any of the deck support structures 520 under the clip member 514, and away from the second side edge 354 (optionally including the outwardly tapered flange 358) of the mounting member 212 of the board assembly 140E to allow the second side edge 354 of the mounting member 212 of the board assembly 140E to be positioned under (or removed from under) the second overhang portion 562.

Figure 12B:
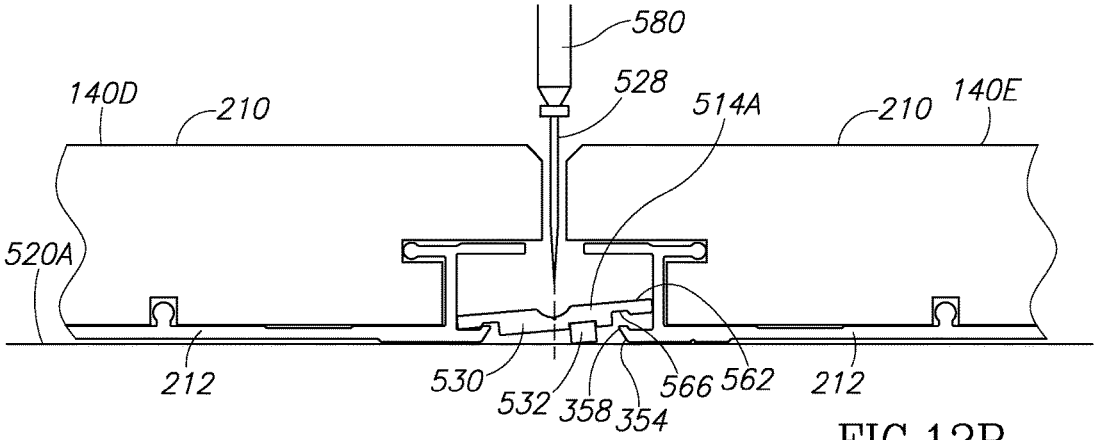
FIG. 12B is cross-sectional view of a fastener being inserted between the first board assembly and a second adjacent board assembly after the second adjacent board assembly has been slid into position relative to the clip member.
Figure 12C:
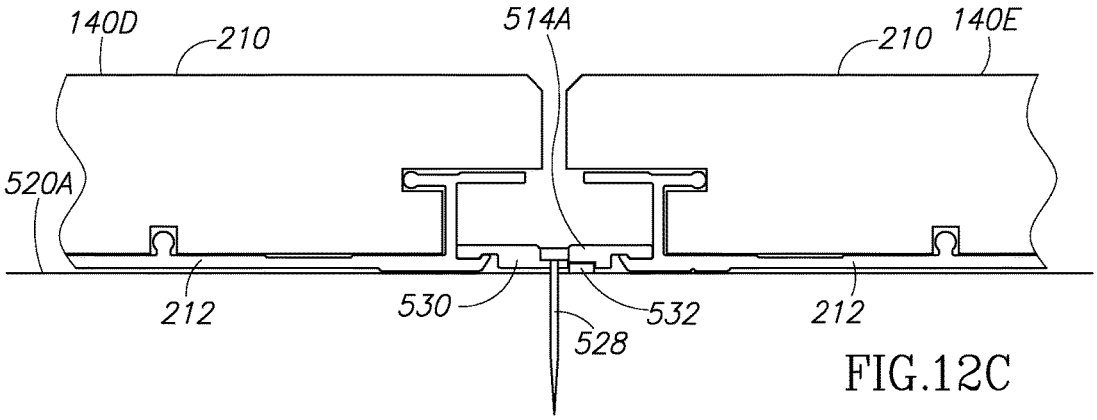
FIG. 12C is cross-sectional view of the first and second board assemblies after the clip member has been fastened to the deck support structure to thereby couple the first and second board assemblies to the deck support structure.

FIGS. 12A-12C are cross-sections depicting the clip member 214A being used to fasten the two board assemblies 140D and 140E to one of the deck support structures 520 (identified as deck support structure 520A). In FIG. 12A, the clip member 214A is positioned on the board assembly 140D with the first side edge 352 of the mounting member 212 of the board assembly 140D positioned inside the first groove 564. The spacer member 532 rests upon the deck support structure 520A and spaces the second overhang portion 562 forwardly farther from the deck support structure 520A than the first overhang portion 560. Then, the board assembly 140E is slid (in a direction identified by an arrow 272) toward the clip member 514A until the second side edge 354 of the mounting member 212 of the board assembly 140E is under the second groove 566.

Next, as shown in FIG. 12B, a tool 580 (e.g., a power screw driver, nail gun, and the like) is used to insert the fastener 528 between the board assemblies 140D and 140E, and into the through-hole 550 (see FIGS. 10 and 11) formed in the clip body 530 of the clip member 514A. The tool 580 drives the fastener 528 through the through-hole 550 (see FIGS. 10 and 11) and into the deck support structure 520A. As the fastener 528 is driven into the deck support structure 520A, the spacer member 532 compresses causing the second overhang portion 562 to move toward the second side edge 354 of the mounting member 212 of the board assembly 140E. When the spacer member 532 is sufficiently compressed, the second side edge 354 (optionally including the outwardly tapered flange 358) of the mounting member 212 of the board assembly 140E is positioned inside the second groove 566 of the clip member 514A as shown in FIG. 12C.

As shown in FIG. 12C, the clip body 530 of the clip member 514A is spaced forwardly from the deck support structure 520A to allow air to flow in between the deck support structure 520A and the clip body 530. The clip body 530 may be wider along the transverse direction "T" than the deck support structure 520A such that the clip body 530 shelters the deck support structure 520A (like a roof) between the board assemblies 140D and 140E. Thus, the clip body 530 may protect the deck support structure 520A from weather (e.g., rain, snow, and the like) and/or debris that could flow or travel downwardly between the board assemblies 140D and 140E. In this manner, referring to FIG. 1, in the deck 500, the deck support structure(s) 520 may be completely sheltered from above by the board assemblies 140 and the clip members 514.

Referring to FIG. 12C, the two board assemblies 140D and 140E may be removed from the deck support structure 520A by removing the fasteners 528 from the clip members 514 to thereby allow the spacer members 532 to decompress. Then, the board assemblies 140D and 140E may simply be lifted from the deck support structure 520A. After they are removed, the board assemblies 140D and 140E may be reused and optionally refinished. Optionally, as mentioned above, the board assemblies 140D and 140E may be recycled. The clip members 514 discarded or reused.

The mounting member 212 adds rigidity to the board assemblies 140 such that even if the board 210 becomes damaged (e.g., rotted), a user will not fall through the deck 500. Further, referring to FIG. 1, the system 510 may require fewer deck screws than conventional methods of installing decks. While the system 510 has been described as being used to construct the deck 500, in alternate embodiments, the system 510 may be used to construct a floor 590 (see FIG. 1) or similar structure. The front side 304 (see FIGS. 3 and 4A) of the board 210 (see FIGS. 2A-4A, 8-10, and 12A-12C) may be configured to provide an aesthetically desired or decorative presentation to a viewer above the deck 500 (see FIG. 7), the floor 590 (see FIG. 1), or similar structure.

The components of the system 510 may be assembled into a kit. Such a kit may include the board assemblies 140 and the clip members 514. Optionally, the kit may include the fasteners 528 and/or the tool 580.

Figure 13:
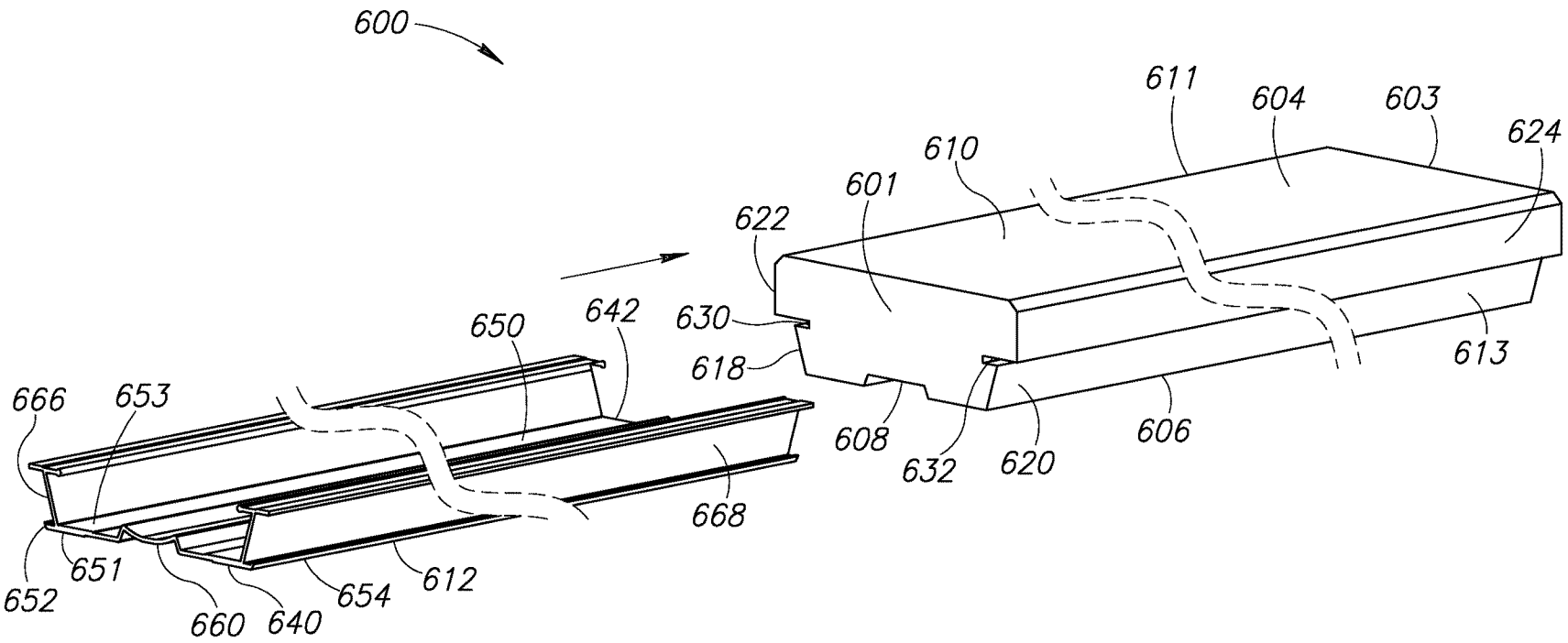
FIG. 13 is an exploded perspective view of an alternate embodiment of a board assembly.
Figure 14A:
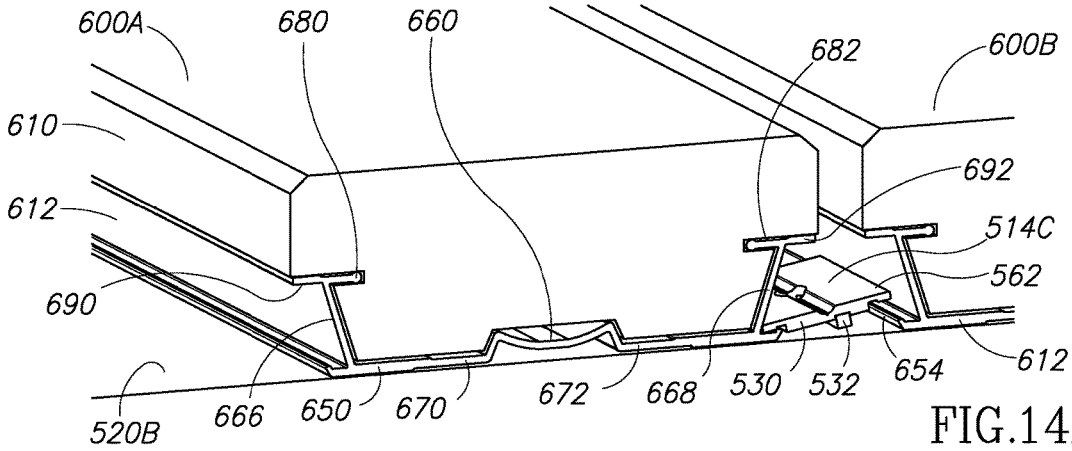
FIG. 14A is cross-sectional view of the clip member resting on a deck support structure and a first board assembly like the board assembly of FIG. 13 before the clip member is fastened to the deck support structure.
Figure 14B:
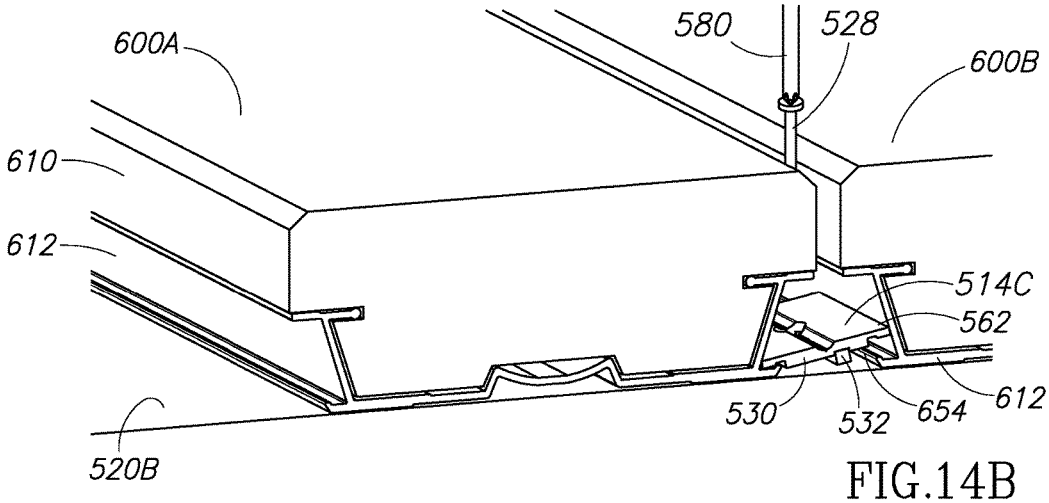
FIG. 14B is cross-sectional view of a fastener being inserted between the first board assembly and a second adjacent board assembly like the board assembly of FIG. 13 after the second adjacent board assembly has been slid into position relative to the clip member.
Figure 14C:
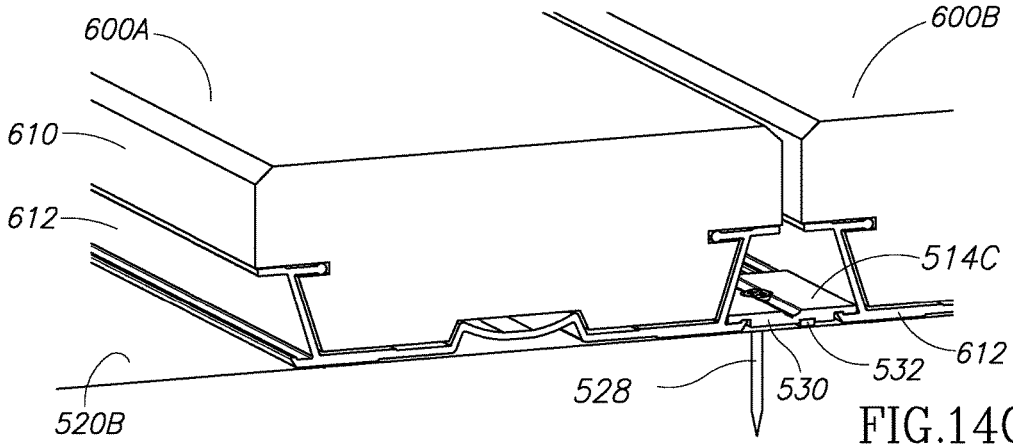
FIG. 14C is cross-sectional view of the adjacent first and second board assemblies after the clip member has been fastened to the deck support structure to thereby couple the first and second board assemblies to the deck support structure.

FIGS. 13-14C depict an alternate embodiment of a board assembly 600 that may be used in place of or instead of each of the board assemblies 140. For example, a plurality of the board assemblies 600 may be used with the clip members 514 to construct a deck, a floor, or similar structure. By way of another non-limiting example, a plurality of the board assemblies 600 may be used with the mounting assemblies 150 to construct a ceiling, a wall, or similar structure. Further, the board assemblies 600 may be included in a kit along with the clip members 514 (and optionally, the fasteners 528 and/or the tool 580) or the components of the mounting assemblies 150 (and optionally, the fasteners 217 and/or the fasteners 218).

Referring to FIG. 13, the board assembly 600 includes a board 610 and a mounting member 612. The board 610 is received by the mounting member 612 in a manner substantially similar to the manner in which the board 210 (see FIGS. 2A-4A, 8-10, and 12A-12C) is received by the mounting member 212 (see FIGS. 2A-4B, 7-10, and 12A-12C). The board 610 may be constructed from any material suitable for constructing the board 210.

The board 610 is elongated and has a first end 601 opposite a second end 603. The board 610 has an outwardly facing front side 604 opposite and inwardly facing backside 606. The front side 604 is generally planar and may be configured to provide an aesthetically desired or decorative presentation to a viewer under the ceiling 100 (see FIG. 1), above the deck 500 (see FIG. 7), above the floor 590 (see FIG. 1), and/or alongside a wall constructed using the board assembly 600. The backside 606 is generally planar with a longitudinally extending center channel 608.

The board 610 has a first side 611 opposite a second side 613 that both extend between the first and second ends 601 and 603. The first and second sides 611 and 613 are mirror images of one another. The first and second sides 611 and 613 have longitudinally extending recessed portions 618 and 620, respectively, adjacent longitudinally extending overhang portions 622 and 624, respectively. A longitudinally extending first side channel 630 is positioned between the overhang portion 622 and the recessed portion 618, and a longitudinally extending second side channel 632 is positioned between the overhang portion 624 and the recessed portion 620. The recessed portions 618 and 620 taper outwardly away from the backside 606 toward the channels 630 and 632, respectively. The recessed portions 618 and 620 and the backside 606 may be characterized as being trapped or encased by the mounting member 612.

The mounting member 612 is elongated and has a first end 640 opposite a second end 642. The mounting member 612 has a base portion 650 with a first side edge 652 opposite a second side edge 654. The first and second side edges 652 and 654 are substantially identical to the first and second side edges 352 and 354 (see FIGS. 3 and 4B), respectively, which allows the board assemblies 600 to be used with the mounting assemblies 150 (see FIGS. 1, 2B, and 5A-6) and the clip members 514 (see FIGS. 1 and 11). Optionally, the first and second side edges 652 and 654 include the outwardly tapered flanges 356 and 358 (see FIGS. 3 and 4B), respectively The base portion 650 has a backside 651 opposite a front side 653. The front side 653 is configured to extend alongside the backside 606 of the board 610. The base portion 650 includes a frontwardly projecting contoured portion 660 configured to be received inside the center channel 608 of the backside 606 of the board 610. The contoured portion 660 is positioned midway between the first and second side edges 652 and 654.

In the embodiment illustrated, the contoured portion 660 has a generally M-like cross-sectional shape. The mounting member 612 may flex laterally along the contoured portion 660. The contoured portion 660 may also help stiffen the mounting member 612. The contoured portion 660 is configured to allow air to flow between the contoured portion 660 and the inside of the center channel 608. When used to construct the deck 500 (see FIG. 7), the contoured portion 660 also allows air to flow in between the mounting member 612 and those of the deck support structures 520 upon which the board assembly 600 rests.

First and second spaced apart sidewalls 666 and 668 extend frontwardly from the base portion 650. The sidewalls 666 and 668 are configured to extend alongside the recessed portions 618 and 620, respectively, of the board 610 (see FIG. 4A). In the embodiment illustrated, the sidewalls 666 and 668 taper outwardly away from the base portion 650.

The sidewalls 666 and 668 are spaced inwardly away from the first and second side edges 652 and 654, respectively. In the embodiment illustrated, the contoured portion 660 is positioned midway between the sidewalls 666 and 668, and the first and second side edges 652 and 654 extend outwardly away from the sidewalls 666 and 668, respectively, in opposite directions.

Referring to FIG. 14A, the base portion 650 may include thinner portions 670 and 672 positioned alongside the contoured portion 660. In the embodiment illustrated, the thinner portion 670 is positioned between the first sidewall 666 and the contoured portion 660, and the thinner portion 672 is positioned between the second sidewall 668 and the contoured portion 660. The thinner portions 670 and 672 allow air to flow between the base portion 650 and the backside 606 of the board 610. When used to construct the deck 500 (see FIG. 7), the thinner portions 670 and 672 also allows air to flow in between the mounting member 612 and those of the deck support structures 520 upon which the board assembly 600 rests.

A first inwardly extending flange 680 substantially identical to the flange 380 (see FIGS. 4A and 4B) extends from the first sidewall 666 toward the second sidewall 668, and a second inwardly extending flange 682 substantially identical to the flange 382 (see FIGS. 4A and 4B) extends from the second sidewall 668 toward the first sidewall 666. Thus, the flanges 680 and 682 extend inwardly toward one another. Referring to FIG. 14A, the first and second inwardly extending flanges 680 and 682 are configured to be received inside the first and second side channels 630 and 632, respectively, of the board 610. Thus, the back side 606 of the board 610 is trapped between the sidewalls 666 and 668, the inwardly extending flanges 680 and 682, and the base portion 650, which helps prevent the board 610 from warping to thereby help keep the board 610 straight along its length. In other words, the board 610 is partially encased by the mounting member 612.

In the embodiment illustrated, a first outwardly extending flange 690 substantially identical to the flange 390 (see FIGS. 4A and 4B) extends from the first sidewall 666, and a second outwardly extending flange 692 substantially identical to the flange 392 (see FIGS. 4A and 4B) extends from the second sidewall 668. The first outwardly extending flange 690 is configured to extend along at least a portion of the underside the overhang portion 622, and the second outwardly extending flange 692 is configured to extend along at least a portion of the underside the overhang portion 624.

The base portion 650, the contoured portion 660, the sidewalls 666 and 668, and the flanges 680, 682, 690, and 692 help prevent the board 610 from twisting or otherwise warping thereby helping to keep the board 610 substantially planar and straight along its length. In other words, the mounting member 612 constrains the movement of the board 610 to maintain the board 610 in a desired substantially planar and straight shape.

The inwardly extending flanges 680 and 682 press inwardly or clamp onto the board 610. This pressing and/or friction between the board 610 and the mounting member 612 helps prevent the board 610 from moving relative to the mounting member 612. In the embodiment illustrated, the mounting member 612 grips the board 610 and prevents it from moving relative to the mounting member 612.

Because the mounting member 612 helps keep the board 610 straight, the board 610 may be longer than board conventionally used to construct ceilings, decks, floors, walls, and the like. Additionally, the board 610 need not be continuous. Instead, a plurality of board sections each like the board 610 may be arranged end-to-end and inserted into the mounting member 612.

In the embodiment illustrated, the mounting member 612 has a length that is substantially equal to the length of the board 610. However, this is not a requirement. In alternate embodiments, the mounting member 612 may have a length that is less than the length of the board 610. Further, the mounting member 612 has been described as being a single unit that extends continuously along the length of the board 610. In alternate embodiments, the mounting member 612 may be implemented as a plurality of like members spaced apart longitudinally along the board 610 that together extend in a discontinuous manner along at least a portion of the length of the board 610.

FIGS. 14A-14C are cross-sections depicting one of the clip members 214 (identified as a clip member 514C) being used to fasten two adjacent board assemblies 600A and 600B (each like the board assembly 600) to one of the deck support structures 520 (identified as a deck support structure 520B). In FIG. 14A, the clip member 514C is positioned on the board assembly 600A in the same manner the clip member 514C is positioned on the board assembly 140D. In other words, the first side edge 652 of the mounting member 612 of the board assembly 600A is positioned inside the first groove 664. At this point, the spacer member 532 rests upon the deck support structure 520B and spaces the second overhang portion 562 forwardly farther from the deck support structure 520B than the first overhang portion 560 (see FIGS. 11 and 12A). Then, the board assembly 600B is slid toward the clip member 514C until the second side edge 654 of the mounting member 612 of the board assembly 600B is under the second groove 566 (see FIGS. 11, 12A, and 12B).

Next, as shown in FIG. 14B, the tool 580 is used to insert the fastener 528 between the board assemblies 600A and 600B, and into the through-hole 550 (see FIGS. 10 and 11) formed in the clip body 530 of the clip member 514C. The tool 580 drives the fastener 528 through the through-hole 550 (see FIGS. 10 and 11) and into the deck support structure 520B. As the fastener 528 is driven into the deck support structure 520B, the spacer member 532 compresses causing the second overhang portion 562 to move toward the second side edge 654 of the mounting member 612 of the board assembly 600B. When the spacer member 532 is sufficiently compressed, the second side edge 654 of the mounting member 612 of the board assembly 600B is positioned inside the second groove 566 of the clip member 514C as shown in FIG. 14C. The clip body 530 of the clip member 514C is spaced forwardly from the deck support structure 520B to allow air to flow in between the deck support structure 520B and the clip body 530. The mounting member 612 adds rigidity to the board assemblies 140 such that even if the board 610 becomes damaged (e.g., rotted), a user will not fall through the deck 500.

The two board assemblies 600A and 600B may be removed from the deck support structure 520B by removing the fasteners 528 from the clip members 514 to thereby allow the spacer members 532 to decompress. Then, the board assemblies 600A and 600B may simply be lifted from the deck support structure 520B. After they are removed, the board assemblies 600A and 600B may be reused and optionally refinished. Optionally, as mentioned above, the board assemblies 600A and 600B may be recycled. The clip members 514 discarded or reused.

The systems 110 and 510 each provide improved airflow to the boards 210 and/or the boards 610 compared to conventional methods of constructing wooden decks, ceilings, floors, walls, and the like. In particular, the mounting members 212 and 612 each provide improved airflow to (the sides and undersides of) the boards 210 and 610, respectively. The system 510 may also provide improved airflow between the board assemblies 140 and the deck support structure(s) 520 when compared to conventional methods of attaching decking to deck support structures.

The mounting member 612, the clip members 214 and 514, and the base member 216 may each be constructed from any material suitable for constructing the mounting member 212. The mounting member 212 may be constructed from a material that does not absorb (or wick) moisture. Additionally, each of the mounting members 212 may be constructed from a material that resists mold and/or does not provide a growth medium (e.g., wood, sap, and the like) for mold or other organisms. By way of a non-limiting example, the mounting member 212 may be constructed from an inorganic material such as aluminum, a material that includes aluminum (e.g., an aluminum alloy), plastic, carbon fiber, and the like. Non-limiting examples of suitable aluminum alloys that may be used to construct the mounting member 212 include 6063-T6 and 6005A.

By way of a non-limiting example, plastic, aluminum, or an aluminum alloy may be extruded to form the mounting member 212. By way of a non-limiting example, a plurality of mounting members each like the mounting member 212 or the mounting member 612 may be manufactured by forming an extrusion that has the cross-sectional shape of the mounting member 212 or the mounting member 612 and a maximum length (e.g., about 40 feet). Then, the extrusion may be cut laterally into two or more sections (e.g., each having a length of about 2 feet, about 3 feet, about 4 feet, about 6 feet to about 12 feet, and the like) with each of the sections being one of the plurality of mounting members.

By using aluminum or an aluminum alloy, the boards 210 and 610 may have improved uniformity (both in terms of flatness and straightness) compared to conventional boards used to construct decks, ceilings, floors, walls, and the like. This helps improve uniformity across multiple stacks for storage and/or transport. Further, the mounting members 212 and 612 help keep the boards 210 and 610, respectively, straight and avoid warping. Additionally, the board assemblies 140 and 600 may have better dimensional stability and strength compared to conventional materials used to construct decks, ceilings, floors, walls, and the like. This allows the board assemblies 140 and 600 to return to their original shape even after multiple uses, which allows them to be reused and to have a longer useful life than conventional materials used to construct decks, ceilings, floors, walls, and the like.

When the mounting members 212 and 612 are constructed using a material that includes aluminum (e.g., aluminum, an aluminum alloy, and the like) they may be lighter in weight and therefore, avoid contributing significantly to transportation costs and building weight.

The mounting members 212 and 612 may be constructed using a recycled and recyclable material (e.g., aluminum, an aluminum alloy, and the like). When the mounting members 212 and 612 are worn out, damaged, or otherwise rendered unusable, they may be recycled.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A board assembly for mounting to at least one support structure of a ceiling, deck, floor, or wall, the board assembly comprising:

a board having a length along a longitudinal direction, and first and second side channels that extend lengthwise along the board; and a mounting member having a base portion, spaced apart first and second sidewalls, and first and second flanges, the first and second sidewalls extending outwardly in a same direction from the base portion, the first and second sidewalls biasing the first and second flanges inwardly toward one another, the first and second flanges being received laterally inside the first and second side channels, respectively, and extending longitudinally along the length of the board, the first and second flanges pressing inwardly on the board to limit movement and warping by the board.

2. The board assembly of claim 1, wherein the base portion is configured to be positioned adjacent a selected one of the at least one support structure, the base portion has a recess positioned immediately adjacent to the selected support structure, and the recess is configured to allow air to flow therethrough between the base portion and the selected support structure.

3. The board assembly of claim 1, wherein the board has an underside with a third channel extending lengthwise therealong, and the base portion comprises an inwardly extending projection configured to be received inside the third channel of the board, and when so received to constrain movement and warping by the board.

4. The board assembly of claim 1, wherein the mounting member further comprises:

third and fourth flanges that extend outwardly from the first and second sidewalls, respectively, and away from one another, wherein the third and fourth flanges are positioned under portions of the board and help prevent the board from twisting or warping lengthwise.

5. The board assembly of claim 1, wherein the board comprises an underside, the base portion is positioned alongside the underside of the board, and the base portion comprises one or more recesses configured to allow air to flow between the base portion and the underside of the board.

6. The board assembly of claim 1, wherein the mounting member is constructed entirely of a material that includes aluminum.

7. The board assembly of claim 1, wherein the base portion has first and second side edges opposite one another, each of the first and second side edges is configured to be coupled to the at least one support structure, and the first and second side edges each comprise an outwardly tapered flange.

8. The board assembly of claim 1, wherein the mounting member further comprises a base portion having an inwardly extending projection, and the board has a third channel configured to receive the projection.

9. The board assembly of claim 8, wherein the projection has a distal edge portion connected to the base portion by a proximal portion, and the distal edge portion is wider than the proximal portion in a direction transverse to the longitudinal direction such that air may flow within the third channel between the proximal portion and the board when the distal edge portion is in contact with the board inside the third channel.

10. The board assembly of claim 1 for use with a clip member, wherein the mounting member further comprises:

first and second side edges opposite one another, each of the first and second side edges being configured to be removably coupled to the at least one support structure by the clip member.

11. The board assembly of claim 1, wherein the mounting member is constructed entirely of aluminum or an aluminum alloy.

12. A kit for use with one or more support structures, the kit comprising:

a plurality of board assemblies each comprising a board partially encased in a mounting member constructed from a material that includes aluminum, the mounting member having first and second flanges received laterally inside first and second side channels, respectively, of the board, the first and second flanges extending longitudinally inside first and second side channels, respectively, to limit lateral movement and warping by the board to help keep the board substantially straight; and a plurality of clip members each configured to couple both first and second adjacent ones of the plurality of board assemblies to the one or more support structures at the same time, each of the plurality of clip members comprising a clip body and a compressible spacer member, each clip member being fastenable to the one or more support structures, wherein before each clip member is fastened to the one or more support structures, the clip body of the clip member is clipped to the first board assembly and the spacer member of the clip member positions the clip body of the clip member to be clipped onto the second board assembly, and fastening each clip member to the one or more support structures compresses the spacer member of the clip member and clips the clip body of the clip member to the second board assembly.

* * * * *